US012611083B2

(12) United States Patent
Ahn et al.

(10) Patent No.: US 12,611,083 B2
(45) Date of Patent: Apr. 28, 2026

(54) DISHWASHER

(71) Applicant: LG Electronics Inc., Seoul (KR)

(72) Inventors: Sangsoo Ahn, Seoul (KR); Seokhyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 112 days.

(21) Appl. No.: 18/598,419

(22) Filed: Mar. 7, 2024

(65) Prior Publication Data

US 2024/0298868 A1 Sep. 12, 2024

(30) Foreign Application Priority Data

Mar. 7, 2023 (KR) ..... 10-2023-0029956

(51) Int. Cl.

| | |
|---|---|
| ***A47L 15/00*** | (2006.01) |
| ***A47L 15/22*** | (2006.01) |
| ***A47L 15/23*** | (2006.01) |
| ***A47L 15/42*** | (2006.01) |

(52) U.S. Cl.

CPC ..... *A47L 15/22* (2013.01); *A47L 15/0049* (2013.01); *A47L 15/23* (2013.01); *A47L 15/42* (2013.01); *A47L 15/4209* (2016.11); *A47L 15/4274* (2013.01); *A47L 15/428* (2013.01); *A47L 2401/24* (2013.01); *A47L 2401/30* (2013.01); *A47L 2501/26* (2013.01)

(58) Field of Classification Search

CPC ..... A47L 15/0049; A47L 15/22; A47L 15/23; A47L 15/42; A47L 15/4209; A47L 15/4274; A47L 15/428; A47L 2401/24; A47L 2401/30

USPC ..... 134/56 D, 57 D, 58 D

See application file for complete search history.

(56) References Cited

U.S. PATENT DOCUMENTS 9,392,926 B2 7/2016 Zardini

FOREIGN PATENT DOCUMENTS

| | | | | |
|---|---|---|---|---|
| DE | 102006007329 B4 | | 2/2018 | |
| EP | 3741284 A1 | * | 11/2020 | ..... A47L 15/4295 |
| JP | 2008-228813 A | | 10/2008 | |
| KR | 10-2022-0090981 A | | 6/2022 | |
| WO | WO 2022/102840 A1 | | 5/2022 | |

OTHER PUBLICATIONS

Riedenklau et al., "EP3741284A1 English Machine Translation.pdf", Nov. 25, 2020—Machine translation from Espacenet.com.*

Extended European Search Report in European Appln. No. 24161840.4, mailed on Jul. 10, 2024, 9 pages.

* cited by examiner

*Primary Examiner* — Levon J Shahinian

(74) *Attorney, Agent, or Firm* — Fish & Richardson P.C.

(57) ABSTRACT

A dishwasher includes: a tub that defines a washing compartment; a rack disposed in the washing compartment; a spray arm disposed below the rack and configured to be rotatable, the spray arm including a nozzle configured to spray wash water toward the rack; a connector disposed at the spray arm and having one open surface; a cap configured to cover the one open surface of the connector and coupled to the connector; a magnet disposed in a space defined by the connector and the cap; a gasket disposed between the connector and the cap; and a sensor configured to detect a magnetic force of the magnet.

20 Claims, 30 Drawing Sheets

DISHWASHER

CROSS-REFERENCE TO RELATED APPLICATIONS

This application claims priority to Korean Patent Application No. 10-2023-0029956, filed on Mar. 7, 2023. The disclosure of the prior application is incorporated by reference in its entirety.

BACKGROUND

1. Field

The present disclosure relates to a dishwasher.

2. Description of the Related Art

A dishwasher is a home appliance designed to clean objects to be washed, such as dishes, cups, spoons, and knives, by spraying wash water to remove food particles or debris left on the objects to be washed.

Such a dishwasher includes a rack disposed in a washing compartment and on which objects to be washed are placed. The dishwasher is provided with a spray arm to spray water onto objects to be washed.

The spray arm may be positioned close to the rack so as to clean objects to be washed placed on the rack. For example, the spray arm may be disposed below the rack.

In addition, the spray arm may also be disposed above the rack.

Further, the spray arm and the rack may be provided in plurality. The plurality of racks and spray arms may be arranged vertically.

The bottom and sides of a rack, typically, consist of wires. In addition, the rack has an open top. Accordingly, a part of an object to be washed may be disposed at the outside of the rack.

The spray arm may be configured to be rotatable. The spray arm may be rotated by a motor, or may be rotated by a reaction force generated by spraying water.

The rotating spray arm may be caught on a part of an object to be washed positioned at the outside of the rack, which may lead to a decrease in rotational speed or cause rotation restraint of the spray arm.

U.S. Pat. No. 9,392,926B2, which is hereby incorporate by reference, discloses a washer machine including a magnet disposed at a spray arm. The magnet is disposed in a cylindrical housing and a stopping element, thereby avoiding contact with water.

However, such a magnet receiving structure is complicated to fabricate.

Furthermore, the cylindrical housing and the shape of the stopping element alone are not enough to properly seal a space therein. For example, water may enter the inner space due to manufacturing tolerances. However, in that publication, a means for sealing the inner space of the cylindrical housing and the stopping element is not disclosed.

The magnet is disposed in an end of the spray arm. Due to this placement of the magnet, it may cause the spray arm to stick to the rack by the magnetic force of the magnet.

KR2022-0090981, which is hereby incorporate by reference, discloses a dishwasher including a magnetic object disposed at the lower side of an end of a spray arm. The magnetic object includes a magnet and a case to accommodate the magnet. However, in that publication, a means for sealing the case is not disclosed.

The magnet is placed so that its poles face a rotation direction of the spray arm. In addition, the poles of the magnet are disposed vertically. When the poles of the magnet are placed vertically, the magnetic force of the magnet may cause the spray arm to stick to the rack.

KR2022-0072650A, which is hereby incorporate by reference, discloses a sensor configured to detect the magnetic force of a magnet. The sensor is provided at a door, and is disposed under a dispenser provided at the door.

The door includes a door liner facing a washing compartment, and the door liner has an inclined portion inclined so that its lower part is positioned forward and its upper part is positioned rearward. Therefore, the lower the position of the sensor, the further the distance from the magnet provided at a spray arm.

In addition, the sensor has a roughly square shape. Accordingly, it may be difficult for the sensor to detect the magnetic force according to the height at which the spray arm is placed.

SUMMARY

It is an objective of the present disclosure to solve the above and other problems.

It is another objective of the present disclosure to provide a dishwasher that can obtain information regarding the rotation of a spray arm.

It is yet another objective of the present disclosure to provide a dishwasher that can detect whether a spray arm is rotating.

It is yet another objective of the present disclosure to provide a dishwasher with a sealed housing for a magnet.

It is yet another objective of the present disclosure to provide a dishwasher that can facilitate the assembly of a housing having an inner space in which a magnet and a gasket are disposed.

It is yet another objective of the present disclosure to provide a dishwasher that can prevent a spray arm from sticking to a rack due to the magnetic force of a magnet.

It is yet another objective of the present disclosure to provide a dishwasher including a sensor configured to detect the magnetic force of a magnet.

It is yet another objective of the present disclosure to provide a dishwasher in which a magnetic field of a magnet is formed in a manner that is easily detected by a sensor.

It is yet another objective of the present disclosure to provide a dishwasher that can allow a sensor to be disposed at a position suitable for detecting a magnetic field of a magnet.

It is yet another objective of the present disclosure to provide a dishwasher that can allow a sensor to be disposed at a door provided with a dispenser.

It is yet another objective of the present disclosure to provide a dishwasher that can allow a sensor to be disposed at a position that does not interfere with an exhaust unit provided at a door.

It is yet another objective of the present disclosure to provide a dishwasher that can allow a sensor to be mounted.

It is yet another objective of the present disclosure to provide a dishwasher that can detect the magnetic force of a magnet and obtaining information regarding whether the magnet is rotating and the rotation of the magnet even when the height at which the magnet is installed is adjusted.

It is yet another objective of the present disclosure to provide a dishwasher including a sensor with increased rigidity.

It is yet another objective of the present disclosure to provide a dishwasher that can allow a sensor to be easily mounted to a mount.

It is yet another objective of the present disclosure to provide a dishwasher that can notify a user about whether there is a possibility of rotation restraint of a spray arm prior to starting a wash cycle.

The objectives of the present disclosure are not limited to the objectives described above, and other objectives not stated herein will be clearly understood by those skilled in the art from the following description.

According to one aspect of the subject matter described in this application, there is provided a dishwasher including a magnet and a sensor configured to detect a magnetic force of the magnet.

The dishwasher may include a spray arm provided with the magnet. The spray arm may be configured to spray wash water.

The dishwasher may include a tub that defines a washing compartment, and a rack disposed in the washing compartment. The dishwasher may include a door to open and close the washing compartment.

The sensor may be disposed at the door or the tub.

The spray arm may be disposed in the washing compartment. The spray arm may be disposed below the rack. The spray arm may spray wash water toward the rack.

The spray arm may include a nozzle configured to spray wash water toward the rack.

The dishwasher may include a connector that is provided at the spray arm, and a cap that is coupled to the connector. The magnet may be disposed in space defined by the connector and the cap.

The connector may have one open surface. The cap may cover the one open surface of the connector.

The dishwasher may include a gasket disposed between the connector and the cap.

The cap may include: a bottom to cover the one open surface of the connector; and a lateral wall that protrudes from the bottom to define a space in which the magnet is accommodated, the lateral wall being inserted inside the connector.

The gasket may be disposed between the lateral wall and the connector. The gasket may be disposed between the lateral wall and the connector in a direction parallel to the bottom.

The connector may include a stopper that protrudes from an inner surface of the connector and is spaced apart from the bottom of the cap.

The gasket may be disposed between the stopper and the bottom of the cap.

The bottom may include: an inner bottom that defines a bottom of the magnet accommodating space surrounded by the lateral wall; and an outer bottom disposed at an outside of the lateral wall.

The cap may include a rim protruding from the outer bottom.

The connector may be inserted between the lateral wall and the rim.

The connector may include a protruding portion protruding from an outer surface of the connector.

The cap may further include: an extended portion recessed outward from an inner surface of the rim, the extended portion defining a groove into which the protruding portion is inserted; and a coupling portion protruding from the extended portion to be engaged with the protruding portion.

The cap may further include a through-hole formed through the bottom at a position corresponding to the coupling portion.

The cap may further include a rib protruding from an inner surface of the lateral wall of the cap to be in contact with the magnet.

The connector may protrude downward from the spray arm, the cap may cover an open lower surface of the connector, and the magnet may be disposed under the spray arm.

The nozzle may protrude from an upper surface of the spray arm, and the magnet may be disposed vertically below the nozzle.

The spray arm may further include a downward-facing nozzle protruding from a lower surface of the spray arm.

The connector may be positioned farther from a center of rotation of the spray arm than the downward-facing nozzle.

A vertical height of the magnet may be greater than a horizontal width of the magnet.

An upper end of the sensor may be positioned upward relative to the magnet, and poles of the magnet may be oriented in an up-and-down direction.

The dishwasher may further include an iron plate placed in the magnet accommodating space surrounded by the lateral wall of the cap, the iron plate being disposed under the magnet.

The dishwasher may further include a silver foil that is placed in the magnet accommodating space and disposed under the iron plate.

According to another aspect of the subject matter described in this application, there is provided a dishwasher including: a tub that defines a washing compartment; a first rack disposed in the washing compartment; a first spray arm deposed below the first rack and including a first nozzle configured to spray wash water toward the first rack; a second rack disposed in the washing compartment and positioned below the first rack; a second spray arm disposed below the second rack and above the first rack and including a second nozzle, the second nozzle being configured to spray wash water toward the second rack; a pump configured to supply wash water to the first spray arm and the second spray arm; a magnet; and a sensor configured to detect a magnetic force of the magnet.

A vertical height of the magnet may be greater than a horizontal width of the magnet.

The dishwasher may further include: a connector protruding downward from the second spray arm and having an open lower surface; and a cap configured to cover the open lower surface.

The magnet may be disposed in an accommodating space defined by the connector and the cap.

The first spray arm may include a first nozzle configured to spray wash water toward the first rack.

The second spray arm may include a second spray nozzle configured to spray wash water toward the second rack.

The sensor may have an upper end positioned upward relative to the magnet, and poles of the magnet may be oriented in an up-and-down direction.

The dishwasher may further include an iron plate placed in the accommodating space and disposed under the magnet.

The dishwasher may further include a silver foil placed in the accommodating space and disposed under the iron plate.

Details of other embodiments are included in the detailed description and the accompanying drawings.

According to at least one of the embodiments of the present disclosure, it is possible to provide a dishwasher capable of obtaining information regarding the rotation of a spray arm.

According to at least one of the embodiments of the present disclosure, it is possible to provide a dishwasher capable of detecting whether a spray arm is rotating.

According to at least one of the embodiments of the present disclosure, it is possible to provide a dishwasher with a sealed housing for a magnet.

According to at least one of the embodiments of the present disclosure, it is possible to provide a dishwasher capable of facilitating the assembly of a housing having an inner space in which a magnet and a gasket are disposed.

According to at least one of the embodiments of the present disclosure, it is possible to provide a dishwasher capable of preventing a spray arm from sticking to a rack due to the magnetic force of a magnet.

According to at least one of the embodiments of the present disclosure, it is possible to provide a dishwasher including a sensor configured to detect the magnetic force of a magnet.

According to at least one of the embodiments of the present disclosure, it is possible to provide a dishwasher in which a magnetic field of a magnet is formed in a manner that is easily detected by a sensor.

According to at least one of the embodiments of the present disclosure, it is possible to provide a dishwasher that allows a sensor to be disposed at a position suitable for detecting a magnetic field of a magnet.

According to at least one of the embodiments of the present disclosure, it is possible to provide a dishwasher that allows a sensor to be disposed at a door provided with a dispenser.

According to at least one of the embodiments of the present disclosure, it is possible to provide a dishwasher that allows a sensor to be disposed at a position that does not interfere with an exhaust unit provided at a door.

According to at least one of the embodiments of the present disclosure, it is possible to provide a dishwasher that allows a sensor to be mounted.

According to at least one of the embodiments of the present disclosure, it is possible to provide a dishwasher capable detecting the magnetic force of a magnet and obtaining information regarding whether the magnet is rotating and the rotation of the magnet even when the height at which the magnet is installed is adjusted.

According to at least one of the embodiments of the present disclosure, it is possible to provide a dishwasher including a sensor with increased rigidity.

According to at least one of the embodiments of the present disclosure, it is possible to provide a dishwasher that allows a sensor to be easily mounted to a mount.

According to at least one of the embodiments of the present disclosure, it is possible to provide a dishwasher capable of notifying a user about whether there is a possibility of rotation restraint of a spray arm prior to starting a wash cycle.

DETAILED DESCRIPTION

Description will now be given in detail according to exemplary embodiments disclosed herein, with reference to the accompanying drawings. For the sake of brief description with reference to the drawings, the same or equivalent components may be denoted by the same reference numbers, and description thereof will not be repeated.

In the following description, a suffix such as "module" and "unit" may be used to refer to elements or components. Use of such a suffix herein is merely intended to facilitate description of the specification, and the suffix itself is not intended to give any special meaning or function.

In the present disclosure, that which is well known to one of ordinary skill in the relevant art has generally been omitted for the sake of brevity. The accompanying drawings are used to help easily understand the technical idea of the present disclosure and it should be understood that the idea of the present disclosure is not limited by the accompanying drawings. The idea of the present disclosure should be construed to extend to any alterations, equivalents, and substitutes besides the accompanying drawings.

It will be understood that although the terms "first", "second", etc. may be used herein to describe various elements, these elements should not be limited by these terms. These terms are only used to distinguish one element from another.

It will be understood that when a component is referred to as being "connected to" or "coupled to" another component, it may be directly connected to or coupled to another component, or intervening components may be present. In contrast, when a component is referred to as being "directly connected to" or "directly coupled to" another component, there are no intervening components present.

As used herein, a singular representation is intended to include a plural representation unless the context clearly indicates otherwise.

Figure 1:
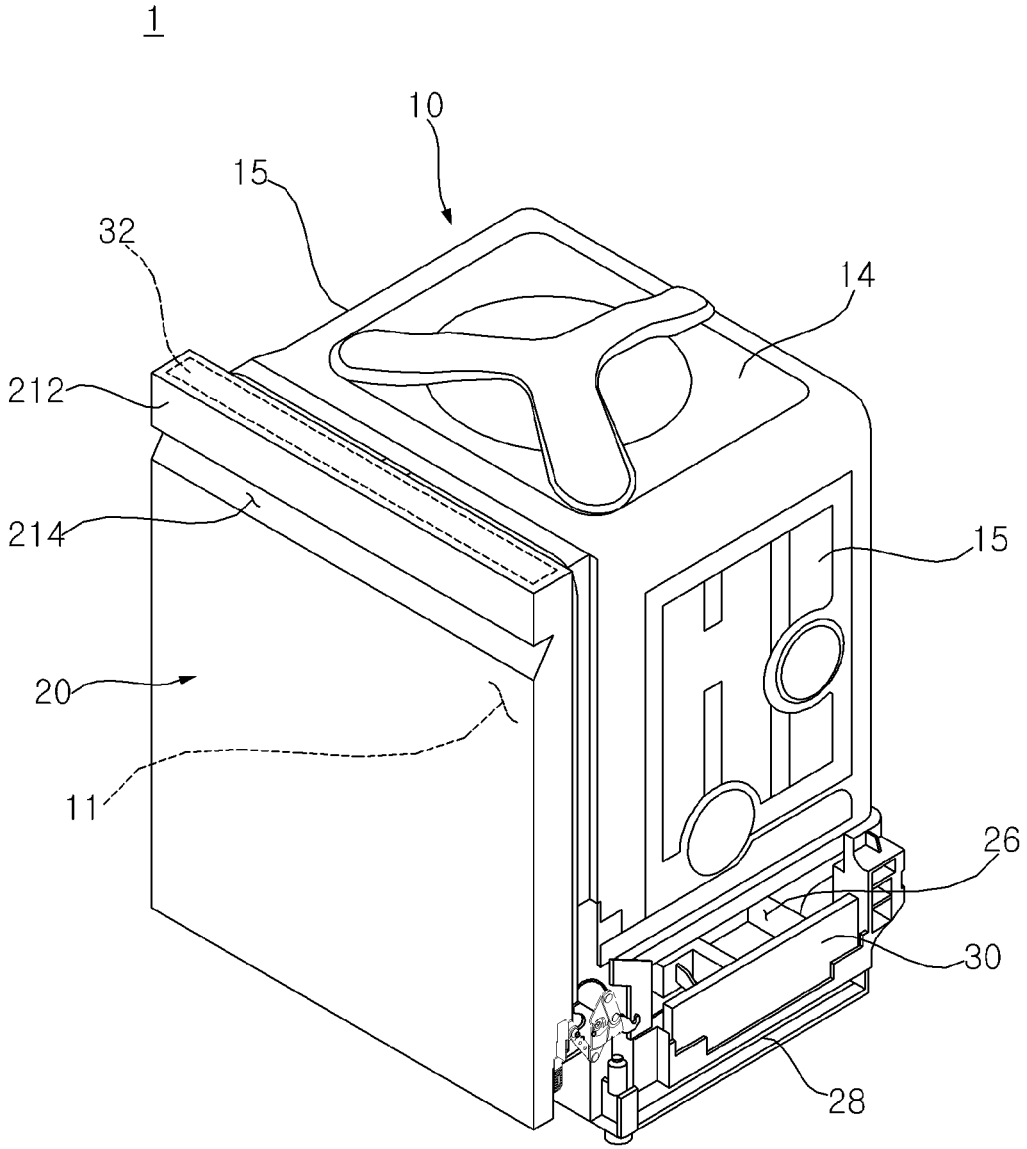
FIG. 1 is a perspective view of a dishwasher according to an embodiment of the present disclosure.

Referring to FIG. 1, a dishwasher 1 includes a tub 10. The tub 10 may define a washing compartment 11. The washing compartment 11 may be provided inside the tub 10.

The tub 10 may include a bottom 12 (see FIG. 3) that defines a bottom surface of the washing compartment 11.

The tub 10 may include a side wall 15 that is connected to the bottom 12 and extends upward. A pair of side walls 15 may be provided. The pair of side walls 15 may be spaced apart from each other. A direction that the pair of side walls 15 are spaced apart from each other may be referred to as a width direction of the washing compartment 11.

The tub 10 may include a top surface 14 that defines a ceiling of the washing compartment 11. The top surface 14 may be connected to the side wall 15. The top surface 14 may connect the pair of side walls 15.

The tub 10 may include a rear wall 16 (see FIG. 3) that is connected to the bottom 12 and the extends upward.

The tub 10 may have a hexahedral shape with one side open. A front or front side of the tub 10 may be open.

Figure 2:
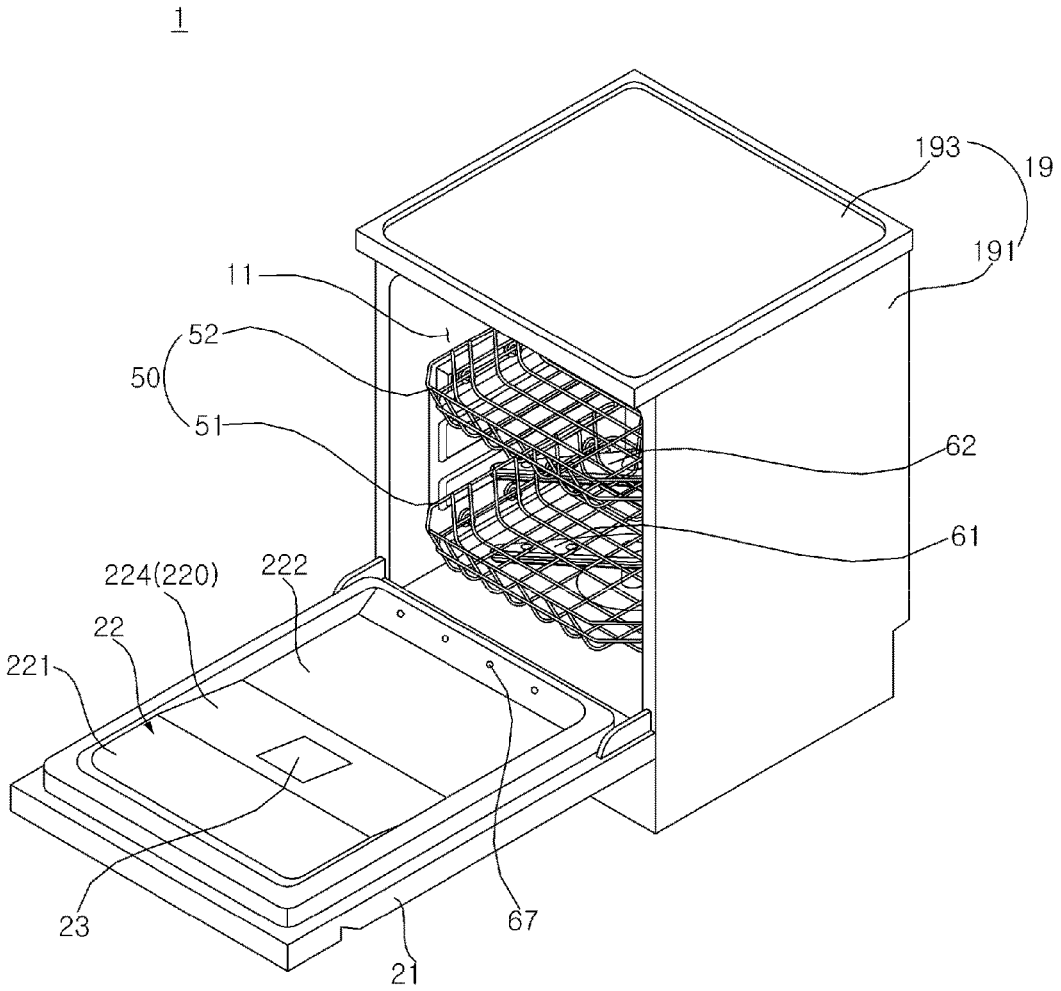
FIG. 2 is a perspective view of a dishwasher with its door opened, according to an embodiment of the present disclosure.

The washing compartment 11 may be open at its front (see FIG. 2). A direction from the opening of the washing compartment 11 toward the rear wall 16 (i.e., a front-and-rear direction) may be referred to as a depth direction of the washing compartment 11.

The dishwasher 1 may include a door 20 that opens and closes the washing compartment 11. The door 20 may be provided at the front of the tub 10. The door 20 may be rotatably coupled to the front of the tub 10.

A lower portion of the door 20 may be coupled to the tub 10. The door 20 may be hinged to a front lower portion of the tub 10. When the door 20 is opened, an upper portion of the door 20 may face forward (see FIG. 2).

The door 20 may include a door handle 212. The door handle 212 may be provided at the upper portion of the door 20.

A handle groove 214 may be provided under the door handle 212. The handle groove 214 may extend in a width direction of the door 20 (or the width direction of the washing compartment 11).

The dishwasher 1 may include a base 28. The base 28 may define a bottom surface of the dishwasher 1.

The bottom 12 of the tub 10 may be spaced upward from the base 28. A space 26 may be formed between the bottom 12 and the base 28. Components such as a PCB (or controller) 30, a sump 80 described later, a pump 83 described later, and the like may be disposed in the space 26. In the following, the space 26 is referred to as a machinery compartment 26.

An interface 32 may be provided at the top of the door 20. The interface 32 may be disposed on an upper surface of the door 20.

The interface 32 may receive a command input from a user. The interface 32 may provide the user with information regarding the dishwasher.

For example, a user may input a command for a wash cycle and option. For example, the interface 32 may display information regarding wash cycles and options.

The controller 30 may control the dishwasher 1. The controller 30 may receive, through the interface 32, a command input from a user. The controller 30 may provide the user with information about the dishwasher 1 through the interface 32.

The components described hereinafter may be controlled by the controller 30.

Referring to FIG. 2, the dishwasher 1 may further include a casing 19. The casing 19 may be disposed at the outside of the tub 10.

The casing 19 may include a cabinet 191 and a top plate 193. The cabinet 191 may cover the side wall 15 of the tub 10. The top plate 193 may cover the top surface 14 of the tub 10.

As described above, the washing compartment 11 may be open at the front, and the door 20 may open and close the washing compartment 11.

The dishwasher 1 may include a rack 50 disposed in the washing compartment 11. Objects to be washed, such as dishes, spoons, and/or cooking utensils, may be placed on the rack 50.

The rack 50 may include a first rack 51. The first rack 51 may be disposed at a lower portion of the washing compartment 11. The first rack 51 may be disposed on the bottom 12 of the washing compartment 11. Alternatively, the first rack 51 may be disposed above the bottom 12.

The rack 50 may include a second rack 52 positioned above the first rack 51. The height of the position where the second rack 52 is disposed may be adjustable.

The dishwasher 1 may include spray arms 61 and 62. The spray arms 61 and 62 may spray wash water toward the rack 50.

The spray arms 61 and 62 may be disposed below the rack 50. The spray arms 61 and 62 may spray wash water upward.

The spray arms 61 and 62 may include a first spray arm 61. The first spray arm 61 may be disposed below the first rack 51.

The spray arms 61 and 62 may include a second spray arm 62. The second spray arm 62 may be disposed below the second rack 52.

The door 20 may be rotatably coupled to the front lower portion of the tub 10.

The door 20 may include a door cover 21. The door cover 21 may face downward while the door 20 is opened.

The door 20 may include a door liner 22. The door liner 22 may face upward while the door 20 is opened. When a user puts objects to be washed on the rack 50, water drops from the objects to be washed or the rack 50 may fall on the door liner 22.

The dishwasher 1 may include a dispenser 23. The dispenser 23 may be provided at the door liner 22. The dispenser 23 may be disposed in a first region 220 of the door liner 22 described below.

The door liner 22 may include the first region 220. The first region 220 may include a region between an upper end of the dispenser 23 and a lower end of the dispenser 23 in an up-and-down direction of the door 20.

The door liner 22 may include an inclined portion 224. The first region 220 may be a region including the inclined portion 224.

The inclined portion 224 may be inclined with respect to a horizontal direction when the door 20 is opened. The inclined portion 224 may be inclined with respect to a vertical direction when the door 20 is closed. The inclined portion 224 may be inclined with respect to the door cover 21.

The door liner 22 may include an upper portion 221 positioned over the inclined portion 224. The door liner 22 may include a lower portion 222 positioned under the inclined portion 224. The door liner 22 will be described in detail later with reference to FIG. 16.

A sensor 40 (see FIG. 16) described later may be disposed in the first region 220 of the door liner 22. The sensor 40 may be disposed at the inclined portion 224 of the door liner 22.

The dishwasher 1 may include a steam nozzle 67. The steam nozzle 67 may be provided at the door 20. The steam nozzle 67 may be provided on the door liner 22. The stream nozzle 67 may be disposed at a lower inclined portion positioned downward relative to the lower portion 222 of the door liner 22.

Figure 3:
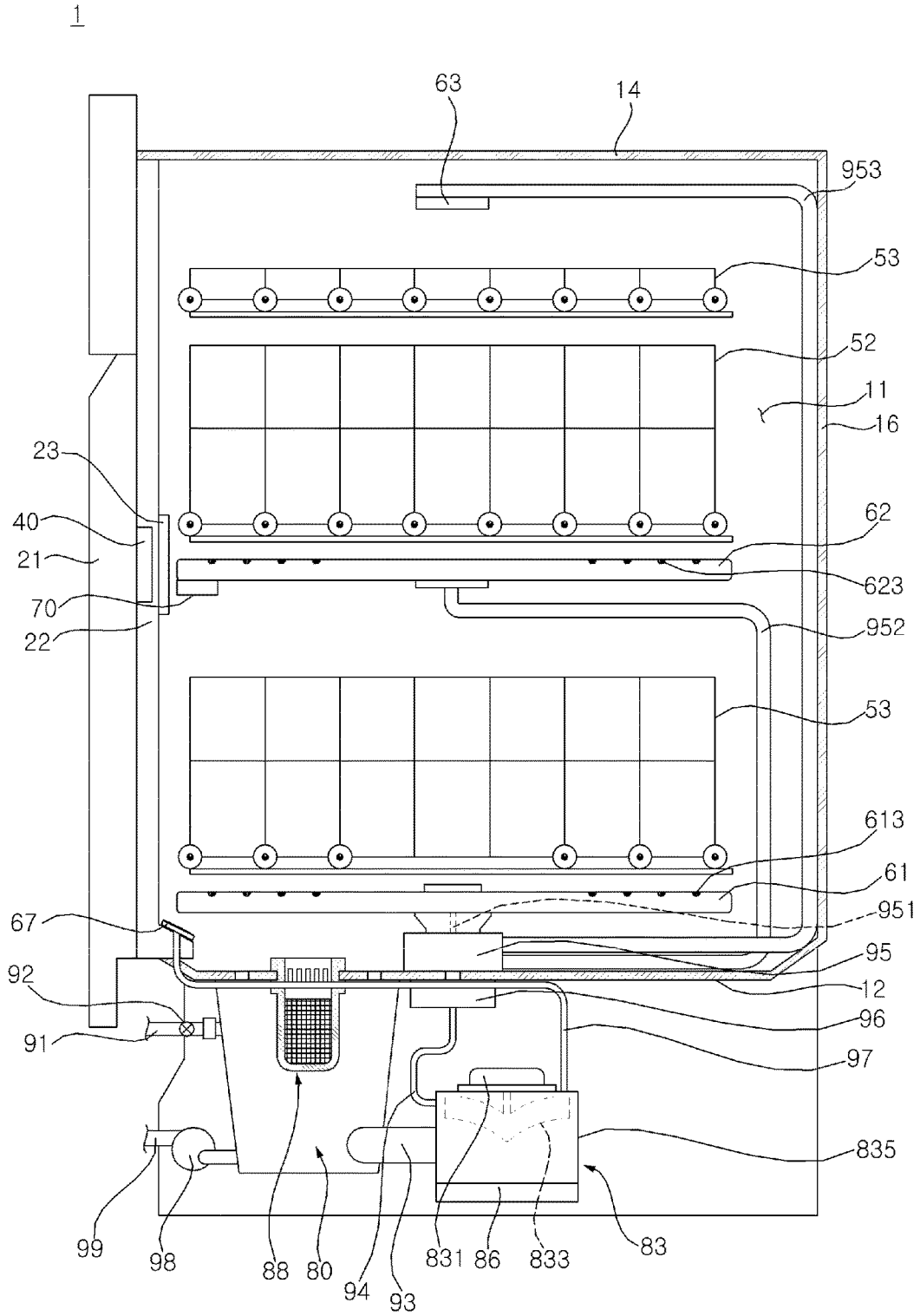
FIG. 3 is a schematic view illustrating the interior of a dishwasher according to an embodiment of the present disclosure.

Referring to FIG. 3, the rack 50 may be configured to be movable in the depth direction of the washing compartment 11. The rack 50 may be slidable. The rack 50 may be drawn out, namely, moved forward from the washing compartment 11. The rack 50 may be drawn in, namely, moved rearward to be disposed in the washing compartment 11.

The first rack 51 may be slidably supported on the side wall 15. The first rack 51 may be slidably supported on a rail provided on the side wall 15.

The height at which the second rack 52 is placed may be adjustable. For example, a rail that supports the second rack 52 may be provided in plurality, and the plurality of rails may be disposed in different positions from each other.

The rack 50 may include a third rack 53. The third rack 53 may be positioned above the first rack 51. The third rack 53 may be positioned above the second rack 52. The third rack 53 may be disposed at the highest position among the plurality of racks 50.

The third rack 53 may be slidably supported on the side wall 15. The second rack 52 may be slidably supported on a rail provided on the side wall 15.

A height between upper and lower ends of the third rack 53 may be less than that of the first and second racks 51 and 52. The third rack 53 may be configured to hold cutlery and/or cooking utensils.

The spray arm 61, 62 may include a nozzle 613, 623 (see FIG. 3). The nozzle 613, 623 may spray wash water.

The spray arm 61, 62 may be configured to be rotatable. The spray arm 61, 62 may be rotated by a motor. The spray arm 61, 62 may be rotated by a reaction force of the force of wash water sprayed through the nozzle 613, 623 of the spray arm 61, 62. For example, the first spray arm 61 may be rotated by a motor, and the second spray arm 62 may be rotated by the reaction force.

The first spray arm 61 may be provided on the bottom 12. The first spray arm 61 may be disposed below the first rack 51. The first spray arm 61 may spray wash water toward the first rack 51.

The first spray arm 61 may include a first nozzle 613. The first nozzle 613 may be provided in plurality. Wash water may be sprayed from the first nozzle 613.

The first spray arm 61 may be configured to be rotatable. The first spray arm 61 may be rotated by a motor. Alternatively, the first spray arm 61 may be rotated by a reaction force of the force of wash water sprayed from the first nozzle 613.

The second spray arm 62 may be disposed below the second rack 52. The second spray arm 62 may be coupled to the second rack 52. The second spray arm 62 may spray wash water toward the second rack 52.

The second spray arm 62 may include a second nozzle 623. The second nozzle 623 may be provided in plurality. Wash water may be sprayed from the second nozzle 623.

The second spray arm 62 may be configured to be rotatable. The second spray arm 62 may be rotated by a reaction force of the force of wash water sprayed from the second nozzle 623. Alternatively, the second spray arm 62 may be rotated by a motor.

The dishwasher 1 may include a top nozzle 63. The top nozzle 63 may be disposed above the rack 50. The top nozzle 63 may be provided at the ceiling 14 of the washing compartment 11. The top nozzle 63 may spray wash water downward. The top nozzle 63 may spray wash water toward the rack 50. The top nozzle 63 may spray wash water toward the third rack 53.

The door 20 may include a door cover 21. The door cover 21 may face the front while the washing compartment 11 is closed by the door 20. The door cover 21 may be exposed to the outside while the washing compartment 11 is closed by the door 20.

The door 20 may include a door liner 22. The door liner 22 may face the washing compartment 11 while the washing compartment 11 is closed by the door 20. The door liner 22 may define a front surface of the washing compartment 11 while the washing compartment 11 is closed by the door 20.

The dishwasher 1 may include a dispenser 23. The dispenser 23 may accommodate a detergent. The dispenser 23 may accommodate a tablet type detergent. Alternatively, the dispenser 23 may accommodate a powered detergent. The dispenser 23 may accommodate a rinse aid.

Meanwhile, some of the nozzles 613, 623 of the spray arms 61, 62 may face the dispenser 20 provided at the door 20. For example, among a plurality of nozzles 623 provided on the second spray arm 62, a nozzle 6231 (see FIG. 4) located at the outermost position may spray wash water to the dispenser 23 according to the rotational position of the second spray arm 62.

The dispenser 23 may be disposed adjacent to the second spray arm 62. The dispenser 23 may be disposed at the same height as the spray arm 62 or at a position slightly higher than the second spray arm 62, so that wash water sprayed from at least one nozzle 6231 of the nozzles 623 of the second spray arm 62 reaches the dispenser 23. In addition, the dispenser 23 may be disposed at a central portion of the door liner 22 in the width direction of the door 20 to be positioned adjacent to the second spray arm 62.

The dishwasher 1 may supply steam to the washing compartment 11.

The steam nozzle 67 may supply steam to the washing compartment 11. The steam nozzle 67 may be provided at the front of the washing compartment 11 to supply steam rearward. The steam nozzle 67 may be provided at a lower portion of the washing compartment 11 to supply steam upward. The steam nozzle 67 may be provided at a front lower portion of the washing compartment 11 to supply steam toward the upper rear side.

The steam nozzle 67 may be provided at the door 20. The steam nozzle 67 may be provided on the door liner 22. The steam nozzle 67 may be provided at a lower portion of the door liner 22. The steam nozzle 67 may be disposed to be inclined with respect to the horizontal direction.

The dishwasher 1 may include a sump 80. The sump 80 may receive water from an external water source such as a tap, etc. The sump 80 may store water supplied from the outside.

The sump 80 may receive water from an external water source through a water supply pipe 91. The water supply pipe 91 may be connected to an external water source.

The water supply pipe 91 may connect the external water source and the sump 80.

A water supply valve 92 may regulate the water supply pipe 91. The water supply valve 92 may control the flow of water flowing from an external water source to the sump 80.

The sump 80 may be disposed under the tub 10. The sump 80 may be disposed under the bottom 12 of the tub 10. The sump 80 may be disposed in the machinery compartment 26. The sump 80 may be connected to the bottom 12 of the tub 10, and may be disposed in the machinery compartment 26.

The sump 80 may store water drained from the washing compartment 11.

The dishwasher 1 may include a filter 88. The filter 88 may remove foreign substances or impurities from water flowing from the washing compartment 11 to the sump 80. The filter 88 may be disposed at the sump 80. The filter 88 may be provided at the bottom 12 of the washing compartment 11.

The dishwasher 1 may include a pump 83 that supplies wash water to the washing compartment 11. The pump 83 may pump water in the sump 80. The pump 83 may pump water to supply it to the spray arms 61 and 62. The pump 83 may pump water to supply it to the top nozzle 63.

The pump 83 may include an impeller 833, a pump housing 835 in which the impeller 833 is accommodated, and a wash motor 831 that causes the impeller 833 to rotate. The wash motor 831 may be a motor with variable rotational speed. For example, the wash motor 831 may be a brushless DC motor (BLDC).

The dishwasher 1 may include a heater 86 to heat wash water. The heater 86 may be connected to the pump 83. The heater 86 may heat water introduced into the pump 83.

Alternatively, the heater 86 may be provided separately from the pump 83. The heater 86 may heat water pumped by the pump 83. Alternatively, the heater 86 may be provided between the sump 80 and the pump 83, so as to heat water introduced into the pump 83.

A switching valve 95 may be connected to the pump 83. The switching valve 95 may receive wash water from the pump 83.

The switching valve 95 may be coupled to a valve coupler 96. The valve coupler 96 may be provided at the sump 80. The valve coupler 96 may define a lower portion of the switching valve 95. The valve coupler 96 may be connected to the pump 83.

The switching valve 95 may be connected to the spray arms 61 and 62 and the top nozzle 63. The switching valve 95 may distribute wash water. The switching valve 95 may selectively supply wash water to at least any one of the first spray arm 61, the second spray arm 62, and the top nozzle 63.

A pump inlet pipe 93 may connect the sump 80 and the pump 83. When the pump 83 is operated, water in the sump 80 may be introduced into the pump through the inlet pipe 93.

An outlet pipe 94 may be connected to the pump 83. The outlet pipe 94 may guide water discharged from the pump 83 toward the spray arms 61 and 62 and the top nozzle 63.

The outlet pipe 94 may be connected to the switching valve 95. The outlet pipe 94 may be connected to the valve coupler 96.

The outlet pipe 94 may connect the pump 83 and the switching valve 95.

Connecting pipes 951, 952, and 953 may connect the spray arms 61 and 62 and the top nozzle 63 to the switching valve 95.

The connecting pipes 951, 952, and 953 may include a first connecting pipe 951 connected to the first spray arm 61. The first connecting pipe 951 may be provided in the first spray arm 61.

The connecting pipes 951, 952, and 953 may include a second connecting pipe 952 connected to the second spray arm 62. The second connecting pipe 952 may be provided at the rear wall of the tub 10.

The connecting pipes 951, 952, and 953 may include a third connecting pipe 953 connected to the top nozzle 63. The third connecting pipe 953 may be provided at the top surface 14 of the tub 10.

When the pump 83 is operated, wash water discharged from the pump 83 may be introduced into the switching valve 95. The wash water introduced into the switching valve 95 may flow to any one of the plurality of connecting pipes 951, 952, and 953 by the switching valve 95.

When wash water flows to the first connecting pipe 951, the wash water may be sprayed from the nozzle 613 of the first spray arm 61.

When wash water flows to the second connecting pipe 952, the wash water may be sprayed from the nozzle 623 of the second spray arm 62.

When wash water flows to the third connecting pipe 953, the wash water may be sprayed from the top nozzle 63.

Wash water sprayed to the washing compartment 11 is collected on the bottom 12 and then is introduced into the sump 80. The wash water introduced into the sump 80 may be sprayed to the washing compartment 11 by the pump 83, and then may be circulated again.

The sump 80 may be connected to a drain pump 98. A drain pipe 99 may connect the sump 80 and the drain pump 98.

When the drain pump 98 is operated, water in the sump 80 may be drained to the outside of the dishwasher 1.

A steam pipe is connected to the steam nozzle 67. The steam pipe connects the steam nozzle to the heater 86.

Figure 4:
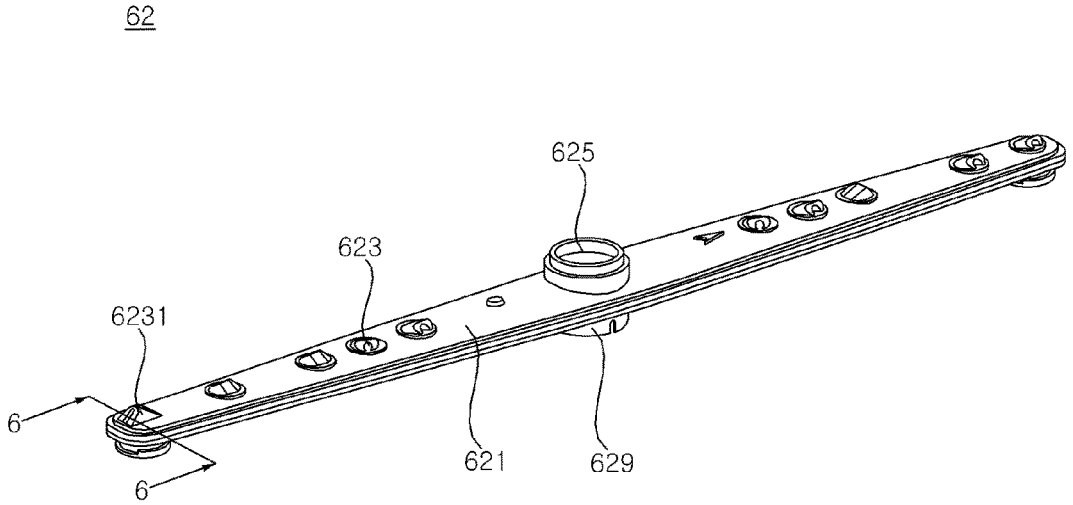
FIG. 4 is a perspective view of a second spray arm of a dishwasher according to a first embodiment of the present disclosure.

Referring to FIG. 4, the second spray arm 62 may include a body 621 and a second nozzle 623 provided on the body 621. The second nozzle 623 may protrude from the body 621.

A plurality of second nozzles 623 may be arranged along a longitudinal direction of the body 621. Among the plurality of second nozzles 623, a nozzle 6231 located at the outermost position may be disposed adjacent to an end in the longitudinal direction of the body 621.

The second nozzle 623 may include an upward-facing nozzle disposed on an upper surface or upper portion 6211 (see FIG. 5) of the body 621, and a downward-facing nozzle disposed on a lower surface or lower portion 6213 of the body 621. The upward-facing nozzle may protrude from the upper portion 6211, and the downward-facing nozzle may protrude from the lower portion 6213.

The upward-facing nozzle may spray wash water toward the second rack 52, and the downward-facing nozzle may spray wash water toward the first rack 51. The upward-facing nozzle may be greater in number than the downward-facing nozzle.

The body 621 may have therein a space through which water flows. The space in the body 621 may communicate with the second nozzle 623.

The second spray arm 62 may include an upper boss 625. The upper boss 625 may be connected to the second connecting pipe 952. The upper boss 625 may communicate with the space in the body 621. The upper boss 625 may protrude upward from the body 621.

The upper boss 625 may be rotatably connected to the second connecting pipe 952.

The second spray arm 62 may include a lower boss 629. The lower boss 629 may protrude downward from the body 621.

The upper boss 625 and the lower boss 629 may be located at a center of rotation of the second spray arm 62. The upper boss 625 and the lower boss 629 may be hollow, i.e., have a cavity therein. The cavity of the upper boss 625 and the cavity of the lower boss 629 may be located on the same line. A supporter may be coupled to the lower boss 629. The supporter may be connected to the second connecting pipe 952.

Hereinafter, the magnet receiving structure of a dishwasher according to one embodiment (or a first embodiment) of the present disclosure will be described with reference to FIGS. 5 to 10.

Figure 5:
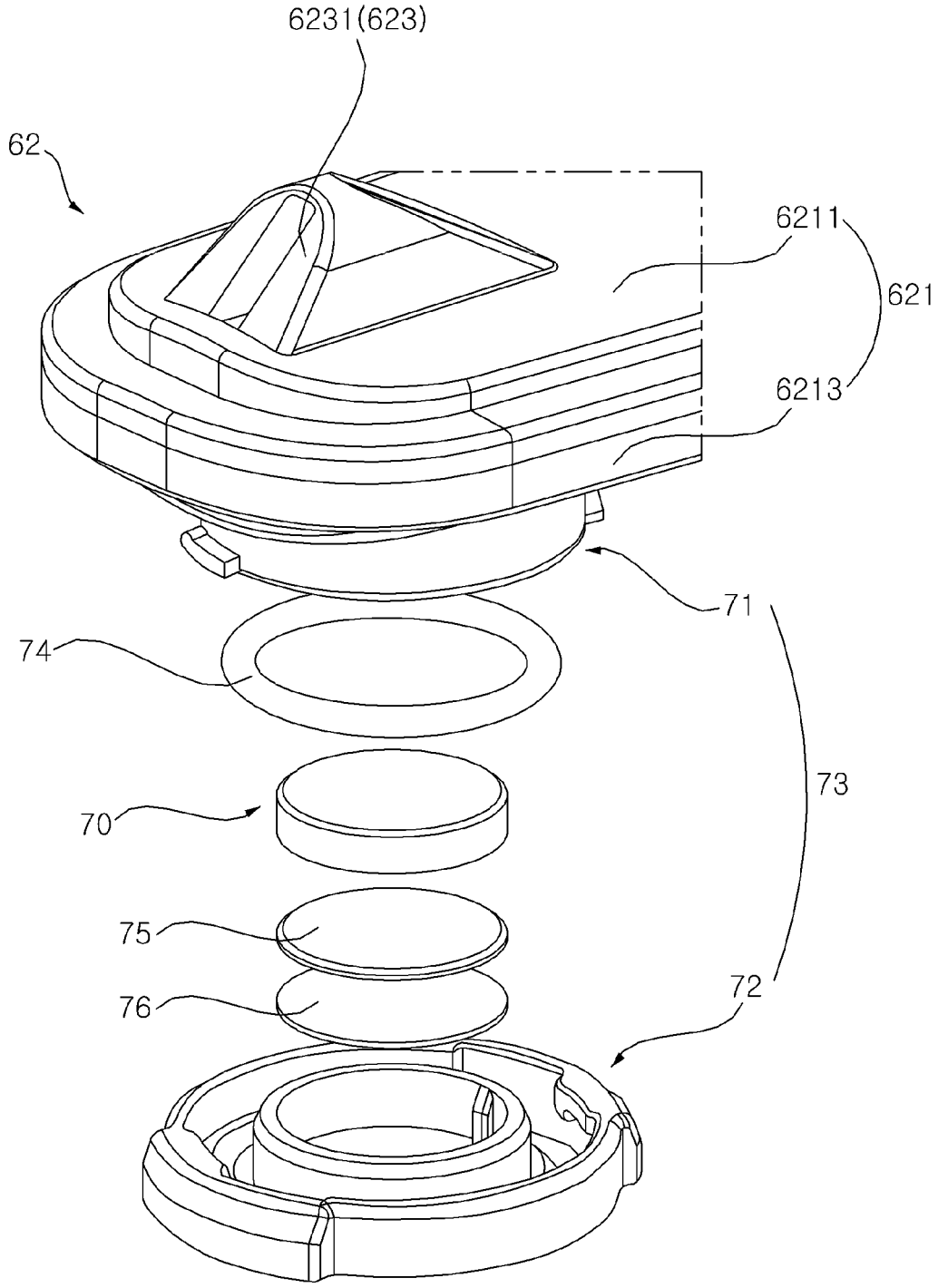
FIG. 5 is an exploded perspective view of the second spray arm shown in FIG. 4.

Referring to FIG. 5, the dishwasher 1 of this embodiment may include a magnet 70. The magnet 70 may be disposed at the second spray arm 62. The magnet 70 may be disposed under the second spray arm 62.

The magnet 70 may be a neodymium magnet or Neodymium-Iron-Boron (NIB) magnet.

The dishwasher 1 may include a housing 73 to accommodate the magnet 70. The housing 73 may be disposed under the second spray arm 62. The housing 73 may include a connector 71 disposed at the second spray arm 62, and a cap 72 coupled to the connector 71.

The connector 71 may be provided at the second spray arm 62. The connector 71 may protrude from the body 621. The connector 71 may be open at its bottom.

The dishwasher 1 may include a gasket 74. The gasket 74 may be disposed in the housing 73. The gasket 74 may seal the inside of the housing 73. The gasket 74 may seal a space in which the magnet 70 is disposed. The gasket 74 may be an O-ring.

The magnet 70 may be configured such that its horizontal width or diameter is greater than its vertical height. Poles of the magnet 70 may be oriented in the up-and-down (or vertical) direction.

A sensor 40 described later may be disposed upward relative to the magnet 70. An upper end of the sensor 40 may be disposed above the magnet 70 (see FIG. 21).

The dishwasher 1 may include an iron plate 75 disposed in the housing 73. The iron plate 75 may be disposed under the magnet 70. The iron plate 75 may cause a magnetic field of the magnet 70 to be up-down asymmetric.

The dishwasher 1 may include a silver foil 76 disposed in the housing 73. The silver foil 76 may be disposed under the iron plate 75. The silver foil 76 may help create an up-down asymmetric magnetic field.

The body 621 may include an upper portion 6211 and a lower portion 6213. A space in communication with the nozzle 623 may be formed between the upper portion 6211 and the lower portion 6213 of the body 621.

The second nozzle (or upward-facing nozzle) 623 may be disposed on the upper portion 6211. The second nozzle 623 may protrude from the upper portion 6211.

Among the plurality of second nozzles 623, a nozzle 6231 located at the outermost position may be disposed adjacent to an edge of the second spray arm 62.

The connector 71 may be disposed at the lower portion 6213. The connector 71 may protrude from the lower portion 6213. The connector 71 may be disposed vertically below the nozzle 6231 that is located at the outermost position among the plurality of second nozzles 623.

The magnet 70 may be placed farther away from the center of rotation of the second spray arm 62 than the aforementioned downward-facing nozzle of the second nozzle 623.

Figure 6:
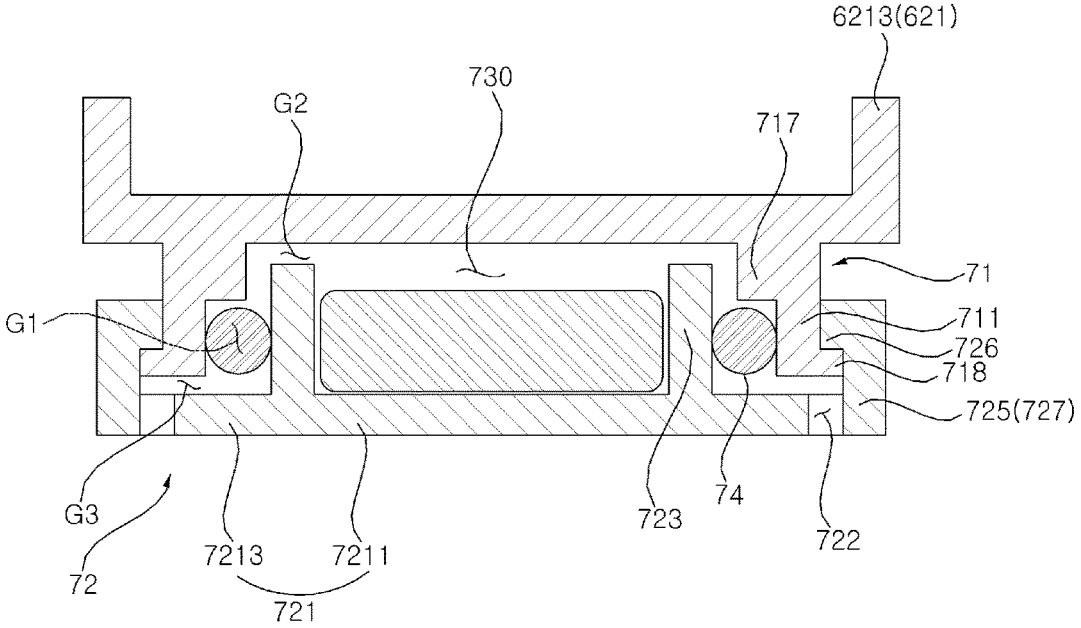
FIG. 6 illustrates a cross section of the second spray arm in FIG. 4, which schematically shows a housing according to a first embodiment of the present disclosure.

Referring to FIG. 6, the magnet 70 may be disposed in a space 730 defined by the connector 71 and the cap 72.

The gasket 74 may be disposed between the connector 71 and the cap 72. As the gasket 74 is disposed between the connector 71 and the cap 72, the space 730 in the housing 73 may be sealed.

Accordingly, it is possible to suppress water from entering the space in which the magnet 70 is disposed.

Figure 7:
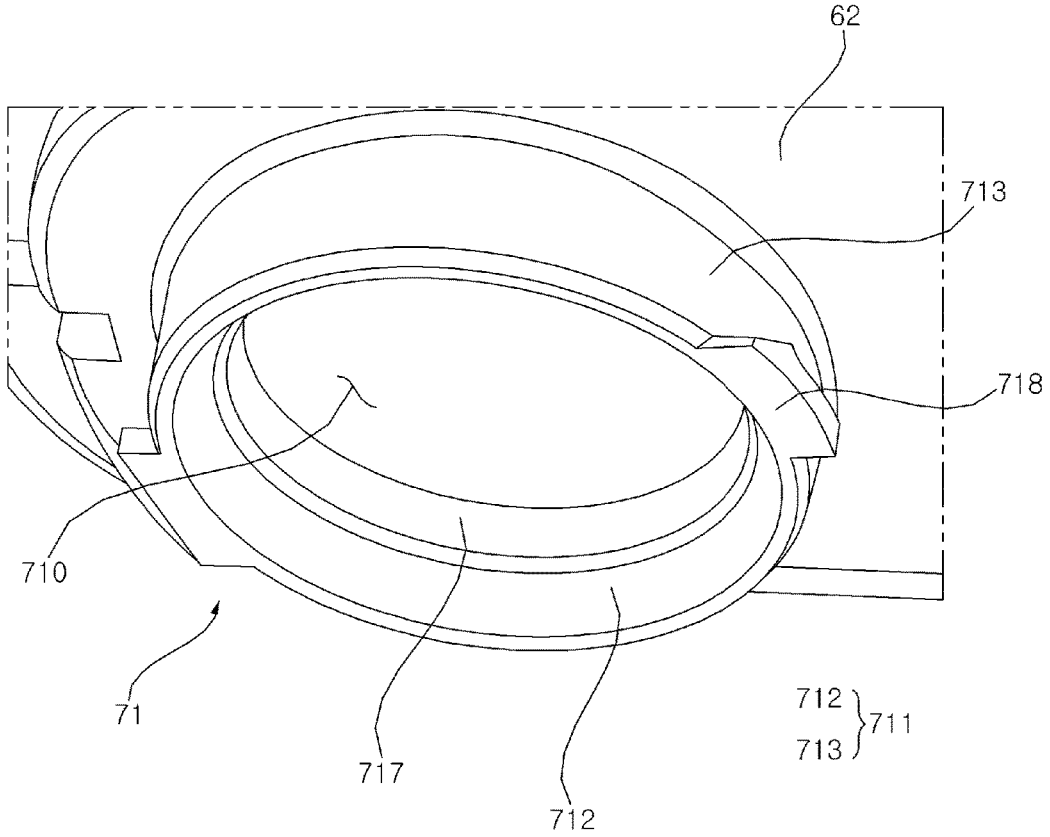
FIG. 7 is a perspective view of a connector shown in FIG. 5.

The connector 71 may have a cylindrical shape that is open at one side and has therein a space 710 (see FIG. 7). The connector 71 may include a circumferential surface 711 of a cylindrical shape. The inner space 710 of the connector 71 may be open at its bottom.

The cap 72 may be coupled to the connector 71. The cap 72 may cover the open lower side of the connector 71. The cap 72 may allow the inner space 710 of the connector 71 to be closed or blocked.

As the connector 71 and the cap 72 are coupled to each other, a closed space 730 of the housing 73 may be formed. The magnet 70 may be disposed in the space 730.

The cap 72 may include a bottom wall 721 that covers the open lower side of the connector 71, and a lateral wall 723 that protrudes from the bottom wall 721.

The bottom wall 721 may be a support plate that extends in a direction intersecting the direction of gravity so as to prevent the magnet 70 from falling by gravity.

The lateral wall 723 may have a cylindrical shape. The lateral wall 723 may have a smaller diameter than the circumferential surface 711 of the connector 71.

The lateral wall 723 of the cap 72 may be inserted inside the circumferential surface 711 of the connector 71. The circumferential surface 711 may be radially spaced apart from the lateral wall 723 of the cap 72. A first gap G1 may be formed between the circumferential surface 711 of the connector 71 and the lateral wall 723 of the cap 72.

The gasket 74 may be disposed between the circumferential surface 711 of the connector 71 and the lateral wall 723 of the cap 72. With respect to a radial direction of the housing 72, the gasket 74 may be disposed between the circumferential surface 711 of the connector 71 and the lateral wall 723 of the cap 72. The gasket 74 may be disposed in the first gap G1.

The gasket 74 may be disposed parallel to the bottom wall 721 of the cap 72. The gasket 74 may be disposed parallel with respect to a longitudinal direction of the bottom wall 721. The gasket 74 may be disposed in a direction intersecting the direction of gravity acting on the magnet.

Referring to FIGS. 6 and 7, the connector 71 may have a cylindrical shape that is open at one side and has a space 710 therein. The connector 71 may include a circumferential surface 711 of a cylindrical shape.

The circumferential surface 711 may protrude from the lower portion 6231 of the body 621. The circumferential surface 711 may be integrally formed with the lower portion 6231 of the body 621.

The circumferential surface 711 may include an inner surface 712 that faces the inner space 710 of the connector 71. The inner surface 712 of the circumferential surface 711 may also be referred to as an inner surface of the connector 71. The inner surface 712 may face the inner space 730 of the housing 73, which accommodates the magnet 70.

The circumferential surface 711 may include an outer surface 713 positioned opposite the inner surface 712.

The connector 71 may include a protruding portion 718 that protrudes from the outer surface 713 of the circumferential surface 711. The protruding portion 718 may be coupled to the cap 72.

The protruding portion 718 may protrude radially outward of the circumferential surface 711. The protruding portion 718 may be formed on a lower end of the circumferential surface 711.

A plurality of protruding portions 718 may be provided. The plurality of protruding portions 718 may be arranged in a circumferential direction of the circumferential surface 711. The plurality of protruding portions 718 may be spaced at an equal interval in the circumferential direction of the circumferential surface 711. For example, two protruding portions 718 may be provided on the circumferential surface 711, and the two protruding portions 718 may be disposed in positions facing each other.

The connector 71 may include a stopper 717 disposed inside the circumferential surface 711. The stopper 717 may be spaced apart from the bottom wall 721 of the cap 72. A first gap G1 may be formed between the stopper 717 and the bottom wall 721 of the cap 72.

The stopper 717 may protrude from the inner surface 712 of the circumferential surface 711. The stopper 717 may protrude downward from the lower portion 6231 of the body 621.

Figure 8:
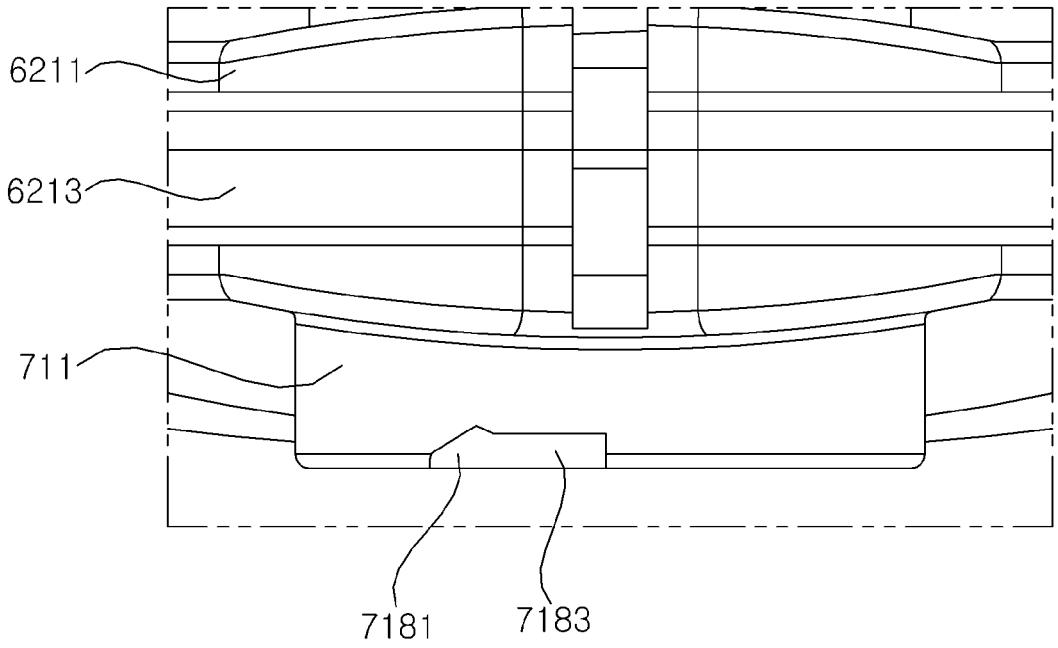
FIG. 8 is a front view of the connector in FIG. 7.

Referring to FIG. 8, the protruding portion 718 may include a head 7181 and a neck 7183. The neck 7183 may extend in the circumferential direction of the circumferential surface 711, and the head 7181 may be disposed at an end of the neck 7183.

The head 7181 may have an inclined surface. The inclined surface may be positioned on the opposite side of the neck 7183.

The protruding portion 718 may be coupled to a coupling portion 726 of the cap 72, which will be described later. The head 7181 may be engaged with a head 7261 of the coupling portion 726 of the cap 72 (see FIG. 9), which will be described later.

Figure 9:
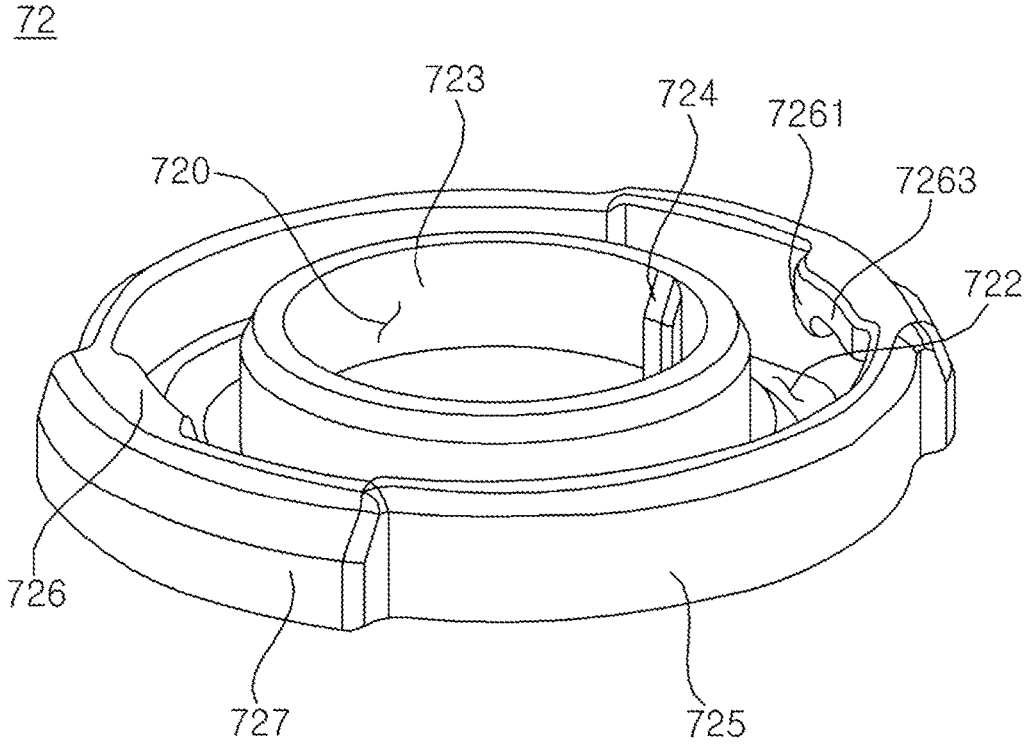
FIG. 9 is a perspective view of a cap shown in FIG. 5.

Referring to FIG. 6 and FIG. 9, the cap 72 may include a bottom wall 721 that covers the open lower side of the connector 71, and a lateral wall 723 that protrudes from the bottom wall 721. The lateral wall 723 may have a cylindrical shape. The lateral wall 723 of the cap 72 may be inserted inside the circumferential surface 711.

The lateral wall 723 may have therein a space 720 in which the magnet 70 is accommodated. The cap 72 may be coupled to the connector 71 while the magnet 70 is disposed in the inner space 720 of the lateral wall 723.

The cap 72 may include a rib 724 that protrudes from the lateral wall 723. The rib 724 may protrude to the inside of the lateral wall 723. This may allow the magnet 70 to be fixed to the space in the lateral wall 723.

The cap 72 may include a rim 725 that protrudes upward from an edge of the bottom wall 721. The rim 725 may have a cylindrical shape open at its top.

The rim 725 may have a larger diameter than the circumferential surface 711 of the connector 71. The circumferential surface 711 of the connector 71 may be inserted inside the rim 725 of the connector 71.

The rim 725 may include an extended portion 727 that extends outward. The extended portion 727 may have the shape of an arc greater in diameter than a remaining portion of the rim 725.

The protruding portion 718 of the connector 71 may be inserted into the extended portion 727.

The rim 725 may include a coupling portion 726 that protrudes from the extended portion 727. The coupling portion 726 may protrude from the extended portion 727 in a radially inward direction of the cap 72. With respect to a circumferential direction of the cap 72, a length of the coupling portion 726 may be less than a length of the extended portion 727.

After inserting the connector 71 into the cap 72 to allow the protruding portion 718 of the connector 71 to be inserted into the extended portion 727, the cap 72 may be assembled to the connector 71 by rotating the cap 72 relative to the connector 71.

The coupling portion 726 may include a neck 7263 that extends in the circumferential direction of the cap 72, and a head 7261 that is disposed at an end portion of the neck 7263. The head 7261 and the neck 7263 of the coupling portion 726 may have a shape corresponding to the head 7181 and the neck 7183 of the protruding portion 718.

The gasket 74 may have a ring shape that extends along the lateral wall 723. The gasket 74 may be disposed at an outer circumference of the lateral wall 723.

The gasket 74 may include a material having elasticity. The gasket 74 may be in close contact with the lateral wall 723.

The cap 72 may be coupled to the connector 71 while the gasket 74 is disposed at the outer circumference of the lateral wall 723.

The gasket 74 may be disposed between the circumferential surface 711 of the connector 71 and the lateral wall 723 of the cap 72. With respect to the radial direction of the housing 73, the gasket 74 may be disposed between the circumferential surface 711 of the connector 71 and the lateral wall 723 of the cap 72. The gasket 74 may be disposed in the first gap G1.

Meanwhile, in order to seal the space 730 in which the magnet 70 is disposed, the gasket 74 may be disposed other than the first gap G1 of the gaps between the connector 71 and the cap 72.

A second gap G2 may be formed between the lateral wall 723 of the cap 72 and the lower portion of the second spray arm 62. When the gasket 74 is disposed in the second gap G2, the gasket 74 may be inserted into an inner circumference of the stopper 717. Alternatively, the cap 72 may be assembled to the connector 71 while the gasket 74 is seated on top of the lateral wall 823.

In this case, the separation of the gasket 74 may occur during the assembly process. Alternatively, the position of the gasket 74 may be changed during the coupling of the cap 72. For example, the gasket 74 may be separated to the inside of the lateral wall 723.

A third gap G3 may be formed between the circumferential surface 711 of the connector 71 and the bottom wall 721 of the cap 72. When the gasket 74 is disposed in the third gap G3, the gasket 74 may be inserted inside the rib 725 of the cap 72.

In this case as well, the separation of the gasket 74 may occur during the assembly process. For example, a portion of the gasket 74 may be separated to the inside of the circumferential surface 711.

In addition, when the gasket 74 is disposed in the third gap G3, it is not suitable for sealing a through-hole 722 formed in the bottom wall 721 of the cap 72.

Figure 10:
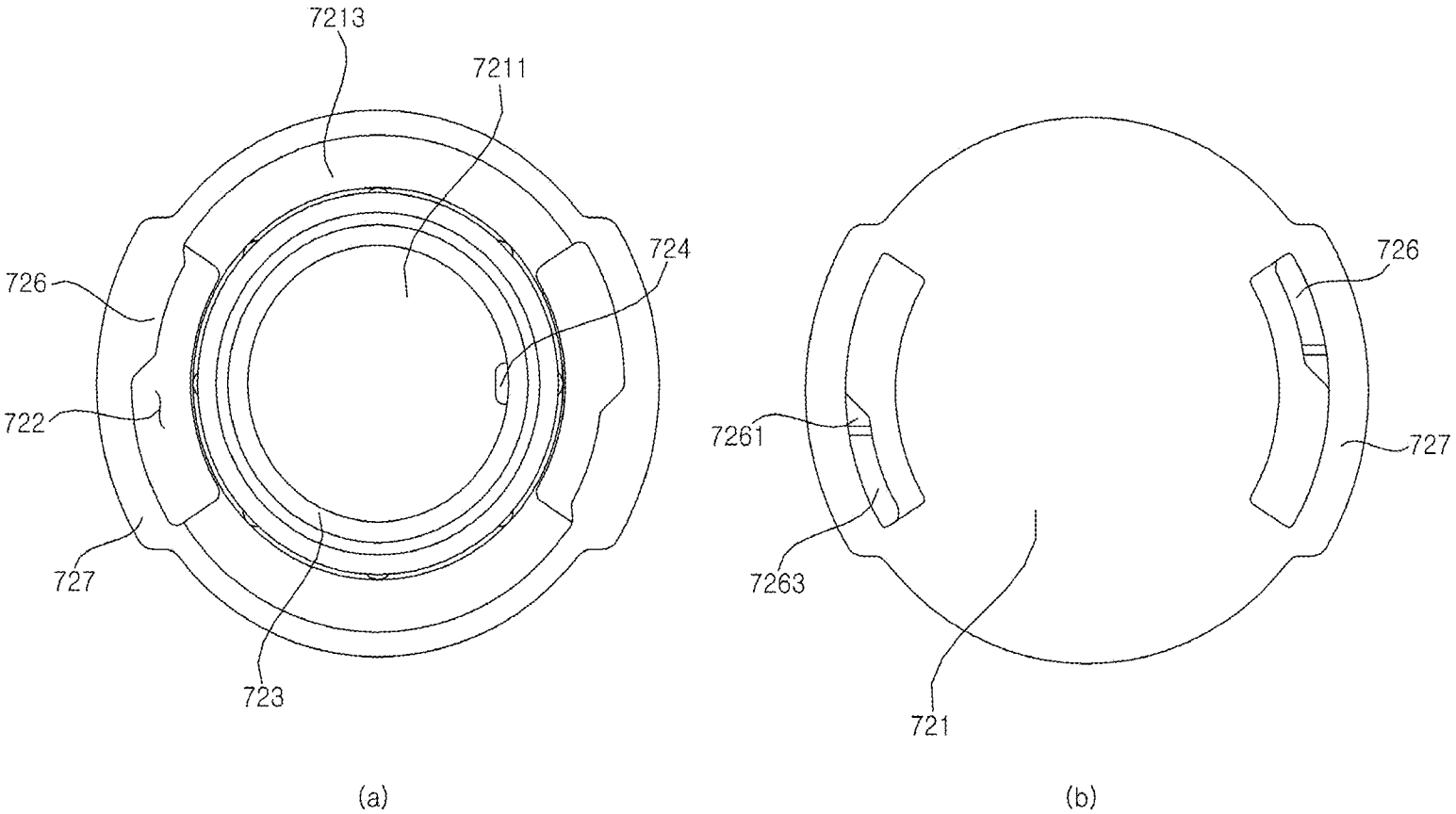
FIG. 10 illustrates a top view and a bottom view of the cap in FIG. 9.

Referring to FIG. 6 and FIG. 10, the lateral wall 723 may have a smaller diameter than the bottom wall 721. The bottom wall 721 may include, with respect to a radial direction of the cap 72, an inner bottom wall 7211 located radially inward of the lateral wall 723 and an outer bottom wall 7213 located radially outward of the lateral wall 723.

A through-hole 722 may be formed in the outer bottom wall 7213. The through-hole 722 may pass through the outer bottom wall 7213.

Meanwhile, a gap may be formed between the connector 71 and the cap 72. For example, due to manufacturing tolerances, a gap may be formed between the circumferential surface 711 of the connector 71 and the rim 725 of the cap 72. Water may enter the gap.

The through-hole 722 may allow water introduced into the gap to be drained. Accordingly, the housing 73 may be washed. In addition, water introduced into the housing 73 may be drained without entering the space 730 in which the magnet 70 is accommodated.

The through-hole 722 may be disposed at a position corresponding to the coupling portion 726. The through-hole 722 may extend in the circumferential direction of the cap 72. The through-hole 722 may be disposed inside the extended portion 727.

Accordingly, a mold may be easily reshaped when forming the cap 72.

Figure 11:
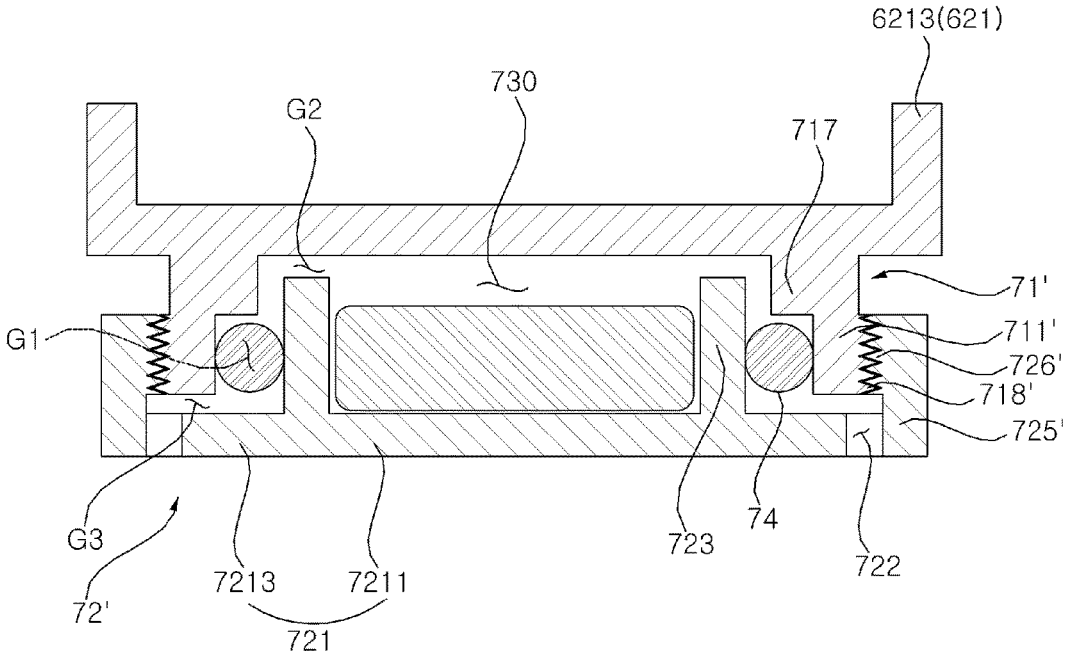
FIG. 11 is a schematic view illustrating a cross section of a housing according to a second embodiment of the present disclosure.

Referring to FIG. 11, a housing (71', 72') according to a second embodiment of the present disclosure may include a connector 71' that is disposed at the second spray arm 62, and a cap 72' that is coupled to the connector 71'.

This embodiment differs from the first embodiment in coupling of the connector 71' and the cap 72'. Description on the configuration and features the same as those of the previous embodiment is omitted below.

The connector 71' and the cap 72' may be screw-coupled to each other.

The connector 71' may include a circumferential surface 711' of a cylindrical shape. The connector 71' may include a first threaded portion 718' provided on an outer surface of the circumferential surface 711'. The first threaded portion 718' may be coupled to the cap 72'.

The cap 72' may include a rim 725' that protrudes upward from an edge of the bottom wall 721. The rim 725' may have a cylindrical shape.

The cap 72' may include a second threaded portion 726' provided on the rim 725'. The second threaded portion 726' may be disposed on an inner surface of the rim 725'. The inner surface of the rim 725' may be a surface facing a radially inward direction of the cap 72'.

The first threaded portion 718' and the second threaded portion 726' may be coupled to each other.

Figure 12:
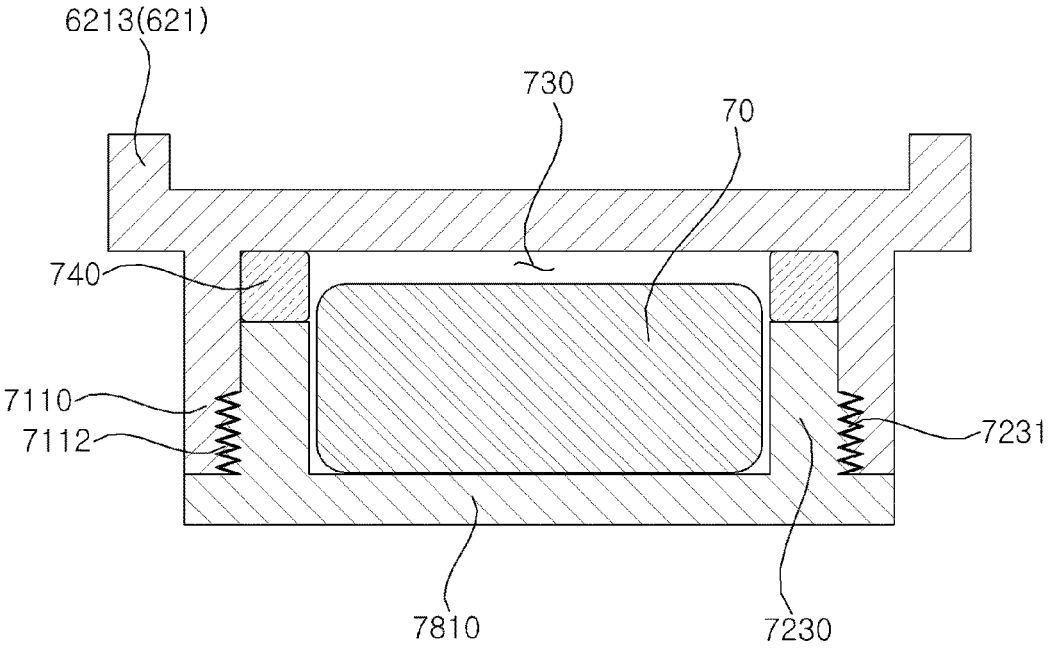
FIG. 12 is a schematic view illustrating a cross section of a housing according to a third embodiment of the present disclosure.

Referring to FIG. 12, a housing according to a third embodiment of the present disclosure may be disposed under the second spray arm 62. The housing may include a connector that is disposed at the second spray arm 62, and a cap that is coupled to the connector.

This embodiment differs from the previous embodiments in the coupling structure of the connector and the cap and the position of the gasket 74. Description on the configuration and features the same as those of the previous embodiments is omitted below.

The connector may be provided at the second spray arm 62. The connector may protrude from the body 621. The connector may be open at its bottom. The connector may have a cylindrical shape that is open at one side and has a space therein.

The connector may include a circumferential surface 7110 of a cylindrical shape. The circumferential surface 7110 may protrude from the body 621 of the second spray arm 62.

The cap may include a bottom wall 7810 that covers the open lower side of the connector, and a lateral wall 7230 that protrudes from the bottom wall 7810.

The bottom wall 7810 may be a support plate that extends in a direction intersecting the direction of gravity, so as to prevent the magnet 70 from falling by gravity.

The lateral wall 7230 may have a cylindrical shape. The lateral wall 7230 may be inserted into the circumferential surface 7110. The circumferential surface 7110 may be coupled to the lateral wall 7230. The circumferential surface 7110 and the lateral wall 7230 may be screw-coupled to each other.

The connector may include a first threaded portion 7112 provided on the circumferential surface 7110. The first threaded portion 7112 may be disposed on an inner circumference of the circumferential surface 7110. The first threaded portion 7112 may be depressed from the inner circumference of the circumferential surface 7110.

The cap may include a second threaded portion 7231 provided on the lateral wall 7230. The second threaded portion 7231 may be disposed on an outer circumference of the lateral wall 7230. The second threaded portion 7231 may protrude from the outer circumference of the lateral wall 7230.

The first threaded portion 7112 and the second threaded portion 7231 may be screw-coupled to each other.

The magnet 70 may be disposed in a space 730 defined by the connector and the cap.

A vertical length of the lateral wall 7230 of the cap may be less than a vertical length of the circumferential surface 7110 of the connector.

A gasket 740 may be inserted into the circumferential surface 7110 of the connector. The gasket 740 may come into contact with the circumferential surface 7110.

The gasket 740 may be disposed on top of the lateral wall 7230 of the cap. With respect to the vertical direction, the gasket 740 may be disposed between the body 621 of the second spray arm 62 and the lateral wall 7230 of the cap. Alternatively, with respect to the vertical direction, the gasket 740 may be disposed between the connector and the lateral wall 7230 of the cap. The gasket 740 may seal the space 730 in the housing.

Hereinafter, the magnet receiving structure of a dishwasher according to another embodiment (or a fourth embodiment) of the present disclosure will be described with reference to FIGS. 13 to 17.

Figure 13:
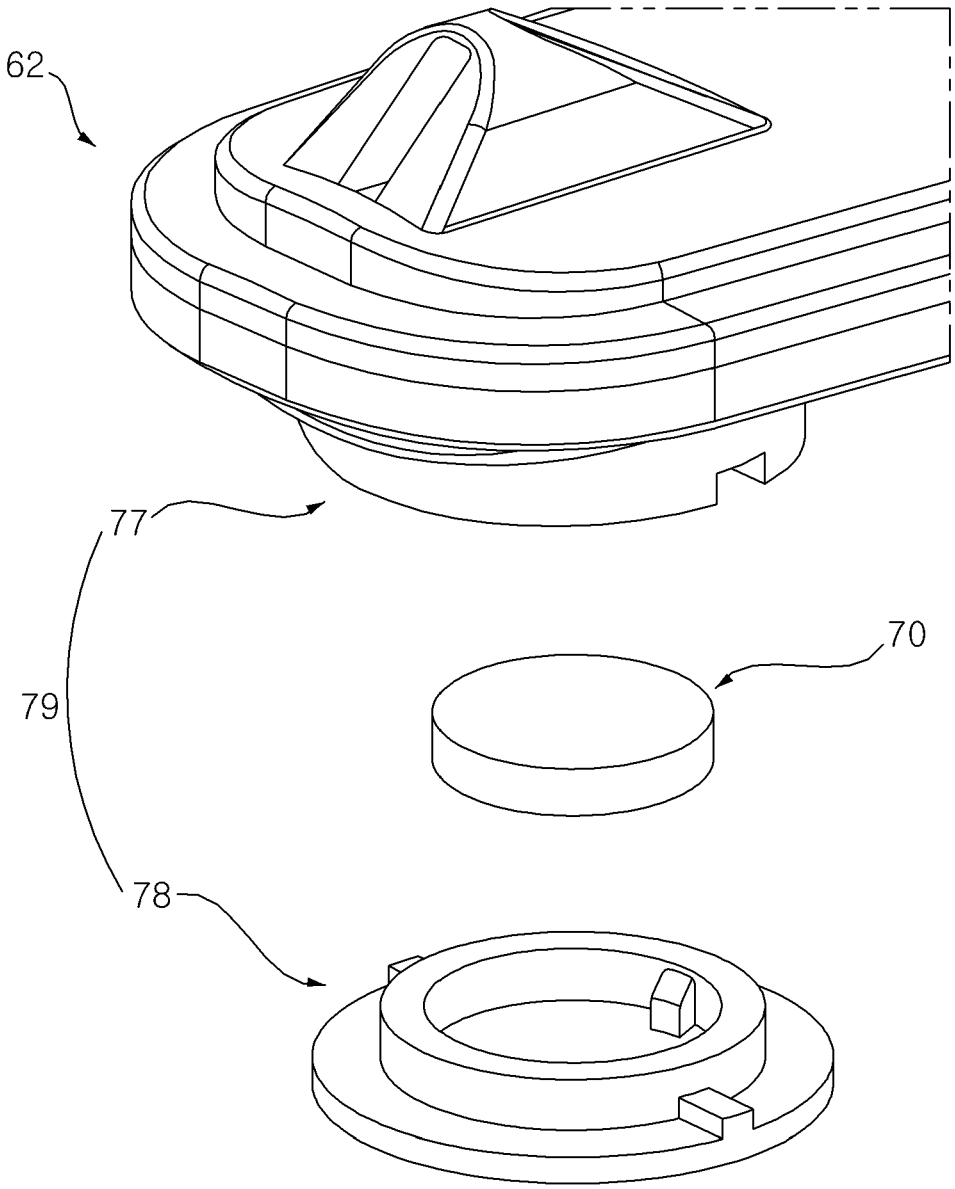
FIG. 13 is a disassembled perspective view of a magnet and a housing according to a fourth embodiment of the present disclosure.

Referring to FIG. 13, the dishwasher 1 of this embodiment may include a magnet 70. The magnet 70 may be disposed at the second spray arm 62.

The dishwasher 1 may include a housing 79 to accommodate the magnet 70. The housing 79 may include a connector 77 that is disposed at the second spray arm 62, and a cap 78 that is coupled to the connector 77.

This embodiment provides a method of sealing an inner space 790 (see FIG. 14) of the housing 79 using a means other than the gasket.

Description on the configuration identical or similar to that of the previous embodiments is omitted below. In addition, unless otherwise specified, this embodiment and the previous embodiments described above are not mutually exclusive or distinct from each other. That is, any or all elements of this embodiment and the previous embodiments may be combined or combined with each other in configuration or function.

The connector 77 may be provided at the second spray arm 62. The connector 77 may protrude from the body 621 of the second spray arm 62. The connector 77 may be open at its bottom.

The iron plate 75 and/or the silver foil 76 described above may also be disposed in the housing 79 of this embodiment.

The connector 77 may be disposed at the lower portion 6231 of the body 621 of the second spray arm 62. The connector 77 may protrude from the lower portion 6213. The connector 71 may be disposed vertically below the nozzle 6231 that is located at the outermost position among the plurality of second nozzles 623.

Figure 14:
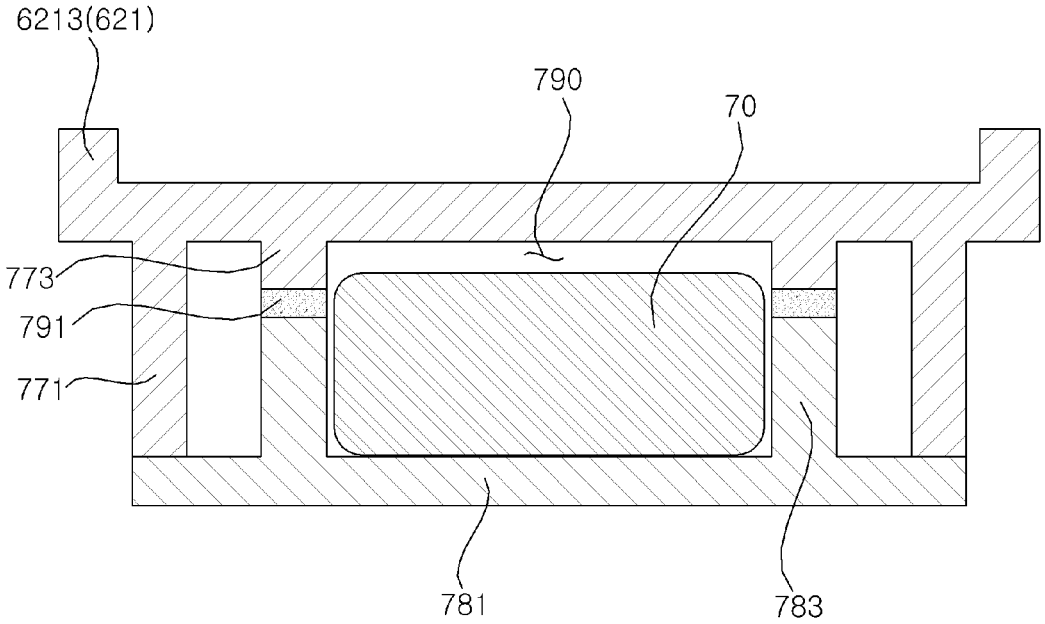
FIG. 14 is a schematic view illustrating a cross section of the housing in FIG. 13.

Referring to FIG. 14, the magnet 70 may be disposed in a space 790 defined by the connector 77 and the cap 78. The connector 77 and the cap 78 may be bonded or welded to each other. The space between the connector 77 and the cap 78 may be closed by bonding or welding.

The connector 77 may include a connecting portion 773 that protrudes from the lower portion 6213 of the second spray arm 62, and the cap 78 may include a bottom wall 781 and a lateral wall 783 that protrudes from the bottom wall 781.

The connecting portion 773 of the connector 77 and the lateral wall 783 of the cap 78 may be of cylindrical shapes with the same diameter. The connecting portion 773 and the lateral wall 783 may be connected to each other.

The connecting portion 773 of the connector 77 and the lateral wall 783 of the cap 78 may be bonded together. For example, the connecting portion 773 and the lateral wall 783 may be bonded to each other by an adhesive.

The connecting portion 773 and the lateral wall 783 may be welded together. The connecting portion 773 and the lateral wall 783 may be welded by ultrasonic welding. A welding portion 791 may be placed between the connecting portion 773 and the lateral wall 783, so that the welding portion 791 may be welded to the connecting portion 773 and the lateral wall 783 by ultrasonic welding. For example, the welding portion 791 may be a thermoplastic resin.

The inner space 790 of the housing 79 in which the magnet 70 is disposed may be closed by bonding or welding of the connecting portion 773 of the connector 77 and the lateral wall 783 of the cap 78.

Accordingly, it is possible to suppress water from entering the space in which the magnet 70 is disposed.

Figure 15:
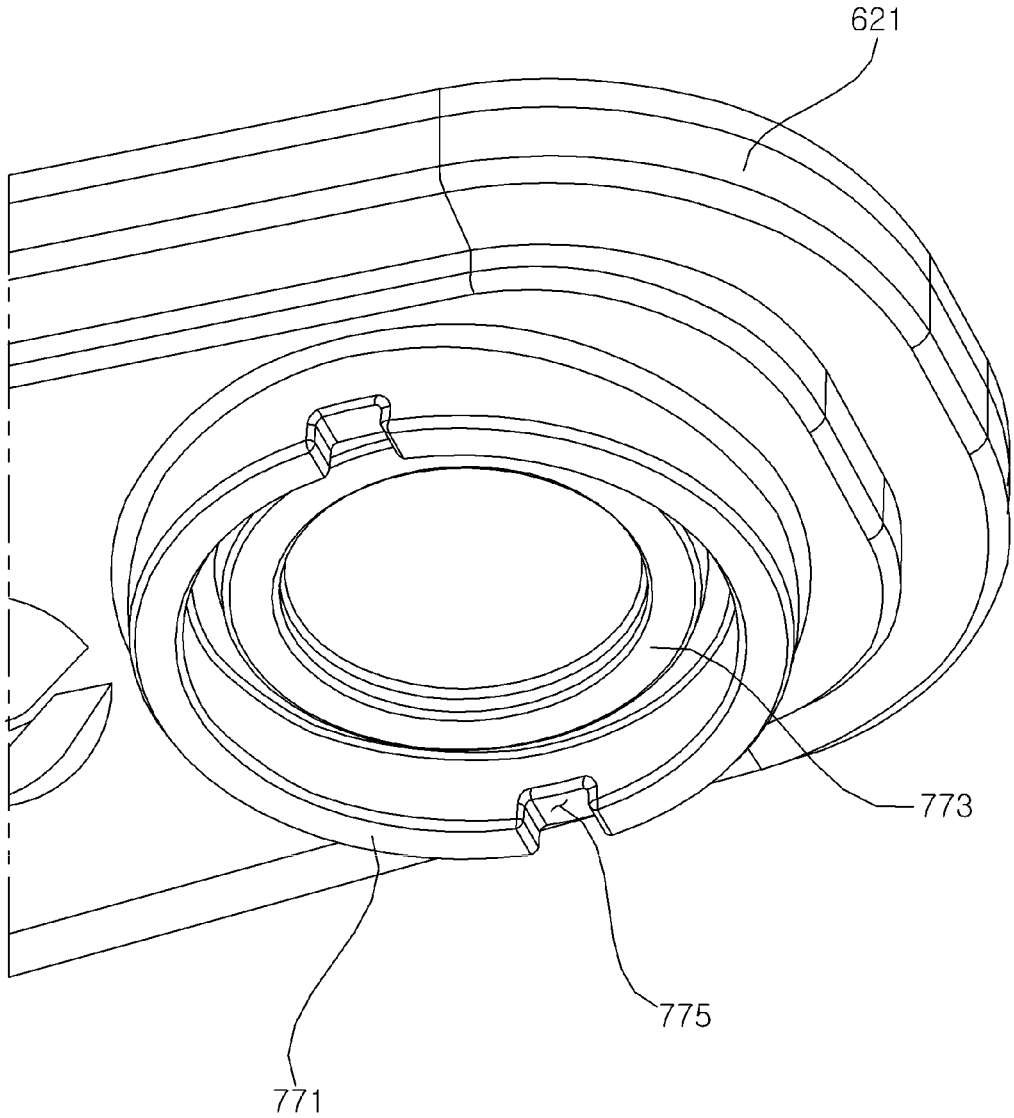
FIG. 15 is a perspective view of a connector shown in FIG. 13.

Referring to FIGS. 14 and 15, the connector 77 may have a cylindrical shape that is open at one side and has a space therein. The connector 77 may include a circumferential surface 771 of a cylindrical shape. The inner space of the connector 77 may be open at its bottom.

The circumferential surface 771 may protrude from the lower portion 6213 of the body 621. The circumferential surface 771 may be integrally formed with the lower portion 6213 of the body 621.

The connector 77 may include a recess 775 recessed from a lower end of the circumferential surface 771. The recess 775 may also be referred to as a positioning recess 775.

A plurality of positioning recesses 775 may be provided. The plurality of positioning recesses 775 may be arranged in a circumferential direction of the circumferential surface 771. The plurality of positioning recesses 775 may be arranged at an equal interval in the circumferential direction of the circumferential surface 771.

The connector 77 may include a connecting portion 773 disposed inside the circumferential surface 771. The connecting portion 773 may protrude from the lower portion 6213 of the body 621. The connecting portion 773 may be spaced apart from the circumferential surface 771 in a radially inward direction of the connector 77. The connecting portion 773 may be connected to the lateral wall 783 of the cap 78.

Figure 16:
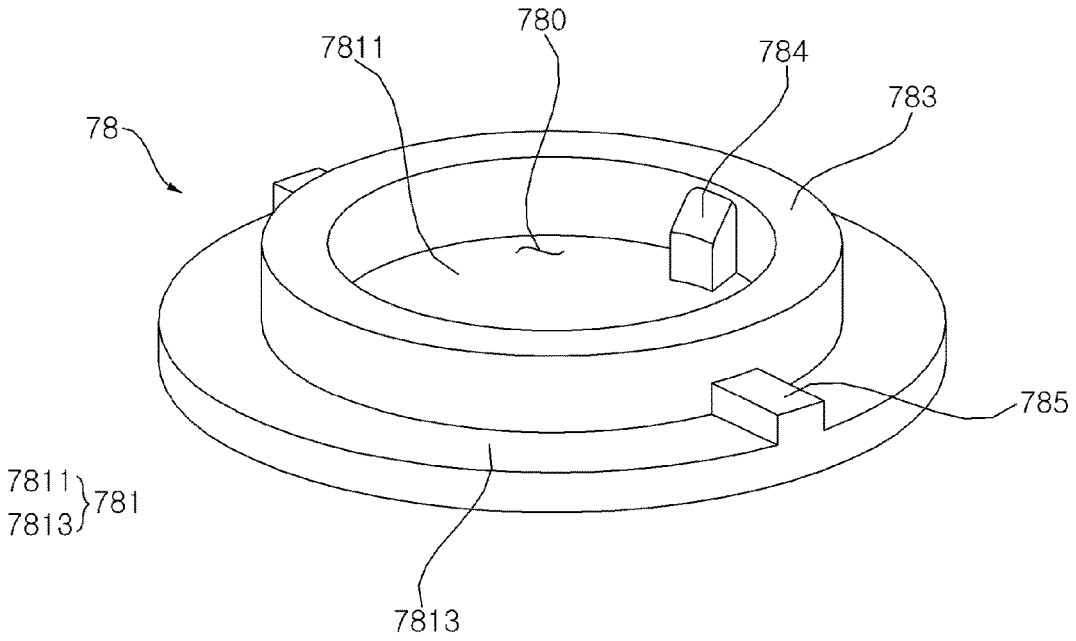
FIG. 16 and FIG. 17 are respectively perspective views of a cap shown in FIG. 13.
Figure 17:
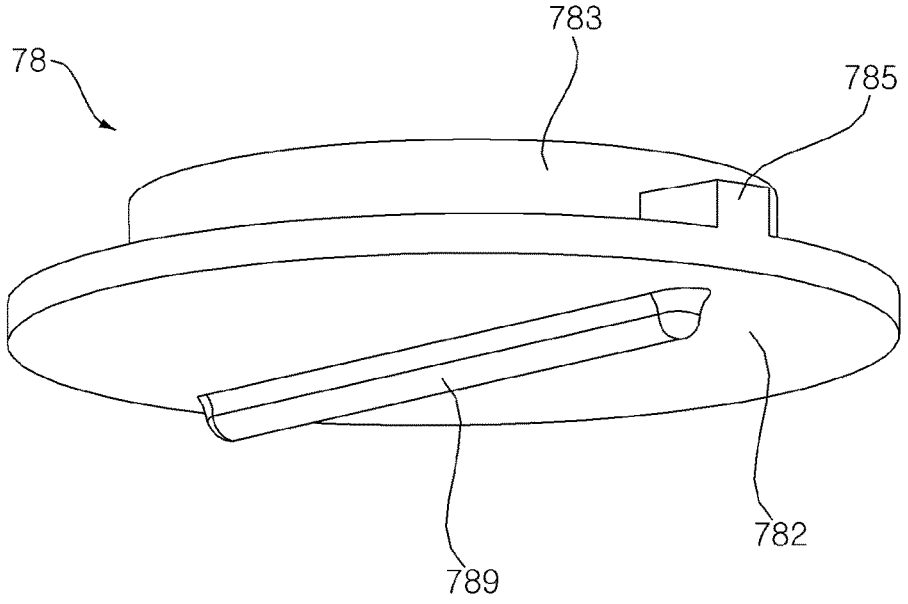

Referring to FIGS. 16 and 17, the cap 78 may include a bottom wall 781 that covers the open lower side of the connector 77, and a lateral wall 783 that protrudes from the bottom wall 781. The lateral wall 783 may have a cylindrical shape. The lateral wall 723 of the cap 78 may be inserted inside the circumferential surface 771.

The lateral wall 783 may have therein a space 780 in which the magnet 70 is accommodated. The cap 78 may be welded or bonded to the connector 77 while the magnet 780 is disposed in the space 780 of the lateral wall 783.

The cap 78 may include a rib 784 that protrudes from the lateral wall 783. The rib 784 may protrude to the inside of the lateral wall 783.

The bottom wall 781 may be larger in diameter than the lateral wall 783. The bottom wall 781 may include, with respect to the radial direction of the cap 72, an inner bottom wall 7811 located in a radially inward direction of the lateral wall 783 and an outer bottom wall 7813 located in a radially outward direction of the lateral wall 783.

The cap 78 may include a protruding portion 785 that protrudes from the bottom wall 781. The protruding portion 785 may also be referred to as a positioning protrusion 785.

The positioning protrusion 785 may be inserted into the positioning recess 775 of the connector 77. The positioning protrusion 785 and the positioning recess 775 may be provided in equal numbers. The positioning protrusion 785 and the positioning recess 775 may have shapes corresponding to each other. A plurality of positioning protrusions 785 may be arranged at an equal interval in a circumferential direction of the lateral wall 783.

The cap 78 may include a lower rib 789 that protrudes from a lower surface 782 of the bottom wall 781. The lower rib 789 may facilitate the coupling of the cap 78 to the connector 77.

For example, an assembler may use the lower rib 789 to adjust the position when applying an adhesive to the lateral wall 783 and attaching it to the connector 77.

For example, the cap 78 may be secured to a welding apparatus through the lower rib 783.

Hereinafter, a rotation detection system of a sensor (40) and a spray arm (61, 62) of the dishwasher 1 according to an embodiment of the present disclosure will be described with reference to FIGS. 18 to 26.

Figure 18:
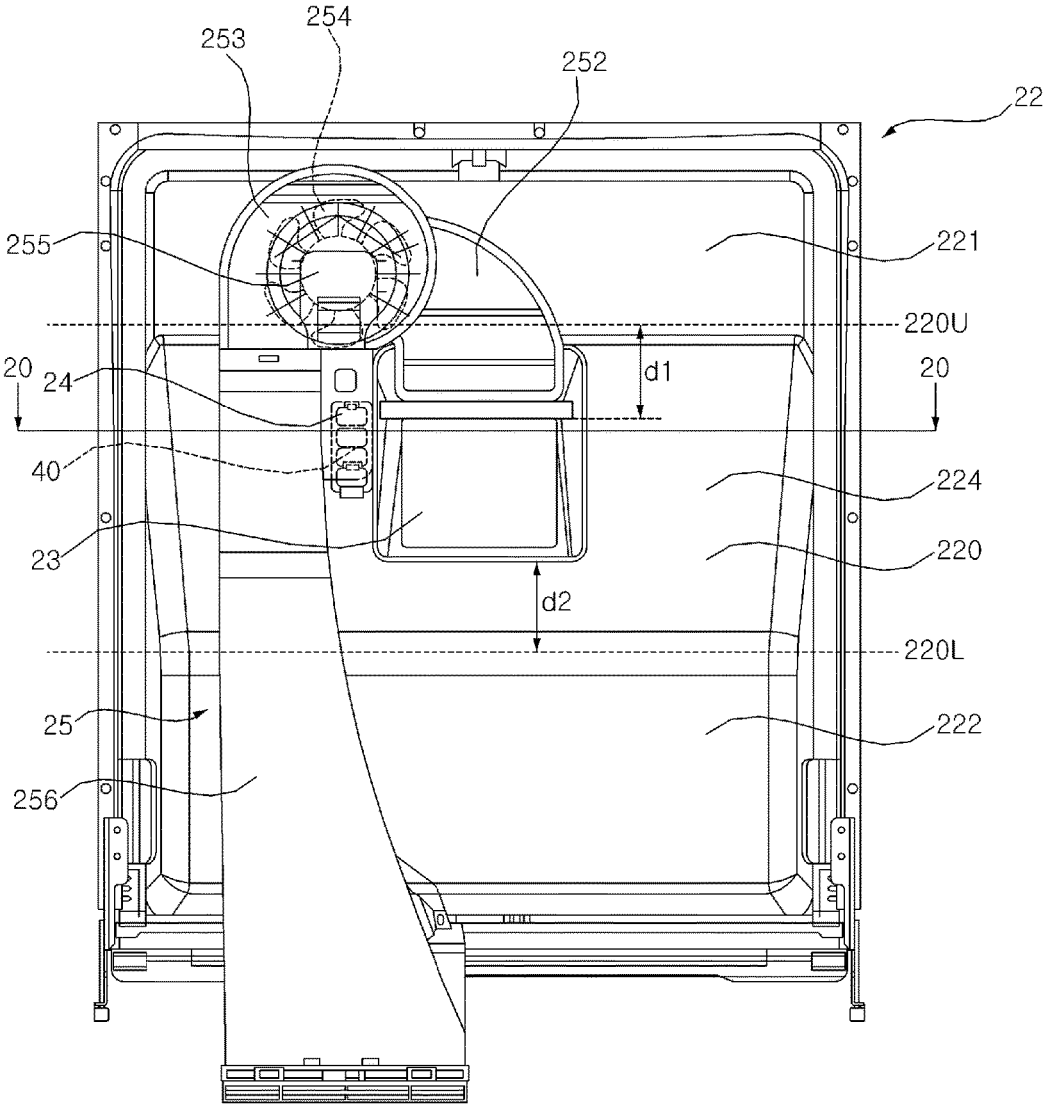
FIG. 18 is a front view of a door with a door cover removed, according to one embodiment of the present disclosure.

Referring to FIG. 18, the dishwasher 1 according to an embodiment of the present disclosure may include a sensor 40. The sensor 40 may detect the magnetic force of the magnet 70. For example, the sensor 40 may include a coil 41 (see FIG. 19). For example, the sensor 40 may include a Hall sensor.

The sensor 40 may be disposed at the door 20. Alternatively, the sensor 40 may be disposed at the tub 10. In the following, a description will be given using an example in which the sensor 40 is disposed at the door 20.

As described above, the door 20 may include the door cover 21 disposed at the front, and the door liner 22 facing the washing compartment 11 (see FIGS. 2 and 3). The door cover 21 may be disposed at the front, and the door liner 22 may be disposed at the rear.

The door liner 22 may include a first region 220. The first region 220 may be a region that corresponds to a height at which the dispenser 23 is placed. When the door liner 22 is divided into a plurality of regions arranged vertically, the first region 220 may be a region in which the dispenser 23 is disposed. In addition, the sensor 40 may be disposed in the first region 220.

The first region 220 may include an upper end of the dispenser 23 and a lower end of the dispenser 23 in the up-and-down direction of the door 20. In addition, the first region 220 may be a region that extends in the width direction of the door 20. The first region 220 may be a region between opposite ends of the door liner 22 in the width direction of the door 20.

The first region 220 may be a region, with respect to the up-and-down direction of the door 20, between a height 220U positioned above the upper end of the dispenser 23 by a predetermined first distance d1 and a height 220L positioned below the lower end of the dispenser 23 by a predetermined second distance d2. In other words, an upper end 220U of the first region 220 may be positioned upward from the upper end of the dispenser 23 by the first distance d1, and a lower end 220L of the first region 220 may be positioned downward from the lower end of the dispenser 23 by the second distance d2.

For example, the first distance and the second distance may be 10 cm. Alternatively, the first distance and the second distance may be 5 cm. Alternatively, the first distance and the second distance may be different from each other.

The first region 220 may be a region, with respect to the up-and-down direction of the door 20, between a height positioned above an upper end of an installation portion 226 by a third distance and a height positioned below a lower end of the installation portion 226 by a fourth distance. For example, the third distance and the fourth distance may be 10 cm. Alternatively, the third distance and the fourth distance may be 5 cm. Alternatively, the third distance and the fourth distance may be different from each other.

The first region 220 may be a region between a lower end of a fan (hereinafter referred to as an "exhaust fan") 254 of an exhaust unit 25 and the lower end of the dispenser 23. Alternatively, the upper end of the first region 224 may be a lower end of a fan housing 253 of the exhaust unit 25. Alternatively, the lower end of the first region 224 may be the lower end of the installation portion 226.

The height at which the dispenser 23 and the sensor 40 are placed may be related to the height at which the second spray arm 62 is placed.

In detail, as described above, the dispenser 23 may be disposed at the same height as the spray arm 62 or at a position slightly higher than the second spray arm 62, so that wash water sprayed from at least one nozzle 6231 of the nozzles 623 of the second spray arm 62 reaches the dispenser 23.

In addition, the height at which the second rack 52 is placed may be varied according to various circumstances, such as the convenience of a user, the size of an object to be washed placed on the second rack 52, and the like, and the height of the second spray arm 62 may be adjusted accordingly.

Therefore, the first region 220 may be defined in relation to the dispenser 40, and, as described above, the first region 220 may be defined as a region, with respect to the up-and-down direction of the door 20, between the height 220U positioned above the upper end of the dispenser 23 by the predetermined first distance d1 and the height 220L positioned below the lower end of the dispenser 23 by the predetermined second distance d2.

In addition, when a distance D (see FIG. 24 or FIG. 25) between the sensor 40 and the magnet 70 is far (or large), it may be difficult to obtain, through the sensor 40, information regarding the rotation of the second spray arm 62. Thus, the sensor 40 may be disposed in the first region 220.

The door liner 22 may include an inclined portion 224. The inclined portion 224 may be inclined with respect to the horizontal direction while the door 20 is opened. The inclined portion 224 may be inclined with respect to the vertical direction while the door 20 is closed. The inclined portion 224 may be inclined with respect to the door cover 21.

In a state where the door 20 is closed, the first region 220 may be inclined so that its upper part is positioned rearward relative to its lower part.

The first region 220 may include the inclined portion 224. Conversely, the first region 220 may be a portion of the inclined portion 224. Alternatively, a portion of the inclined portion 224 may belong to the first region 220, and a remaining portion thereof may be disposed outside the first region 220.

The door liner 22 may include an upper portion 221 positioned over the inclined portion 224. The upper portion 221 may extend upward from the inclined portion 224.

The upper portion 221 of the door 20 may be disposed parallel to the door cover 21. The upper portion 221 of the door 20 may be placed vertically while the door 20 is closed.

The door liner 22 may include a lower portion 222 positioned under the inclined portion 224. The lower portion 222 may extend downward from the inclined portion 224.

The lower portion 222 of the door 20 may be disposed parallel to the door cover 21. The lower portion 22 of the door 20 may be placed vertically while the door 20 is closed.

The sensor 40 may be disposed at the door 20. The sensor 40 may be disposed at the door liner 22. The sensor 40 may be disposed at the front of the door liner 22. The sensor 40 may be provided at the door liner 22. The sensor 40 may be disposed between the door liner 22 and the door cover 21.

The sensor 40 may be disposed in the first region 220. The sensor 40 may be disposed at a height corresponding to the first region 220. The sensor 40 may be disposed at the front of the first region 220.

The sensor 40 may be disposed at the inclined portion 224. The sensor 40 may be disposed at a height corresponding to the inclined portion 224. The sensor 40 may be disposed at the front of the inclined portion 224.

The dispenser 23 may be disposed at the door 20. The dispenser 23 may be disposed at the door liner 22. The dispenser 23 may be provided at the door liner 22.

The sensor 40 may be disposed at a height corresponding to the dispenser 23.

The sensor 40 may overlap the dispenser 20 in the width direction of the door 20.

The dishwasher 1 may include an exhaust unit 25. The exhaust unit 25 may discharge air in the washing compartment 11 to the outside. For example, the exhaust unit 25 may discharge moist air to the outside after wash and rinse cycles are completed, thereby improving the drying performance.

The exhaust unit 25 may be disposed at the door 20. The exhaust unit 25 may be disposed at the door liner 22. The exhaust unit 25 may be disposed at the front of the door liner 22. The exhaust unit 25 may be disposed at the door liner 22. The exhaust unit 25 may be disposed between the door liner 22 and the door cover 21.

The sensor 40 may be disposed between the exhaust unit 25 and the dispenser 23.

The exhaust unit 25 may include an intake grille 251 (see FIG. 25) disposed at the door liner 22. The intake grille 251 may be mounted on the door liner 22. The intake grille 251 may be disposed above the dispenser 23.

The exhaust unit 25 may include an intake duct 252 connected to the intake grille 251. The intake duct 252 may communicate with an intake port. The intake duct 252 may extend upward from the intake grille 25. The intake duct 252 may be disposed over the dispenser 23.

The exhaust unit 25 may include a fan housing 253 and a fan 254. The exhaust unit 25 may include a motor 255 to cause the fan 254 to rotate. The motor 255 may be mounted on the fan housing 253.

The fan housing 253 may be connected to the intake duct 252. The fan housing 253 may be disposed at the upper portion 221 of the door liner 22. The fan housing 252 may be disposed between the upper portion 221 and the door cover 21.

A distance between the upper portion 221 of the door liner 22 and the door cover 21 may be greater than a distance between the lower portion 222 of the door liner 22 and the door cover 21, and the inclined portion 224 may connect the upper portion 221 and the lower portion 222. That is, a space in which the fan housing 253, the fan 254, and the motor 255 are disposed may be secured between the upper portion 221 of the door liner 22 and the door cover 21, and the structure of the inclined portion 224 may allow the space between the door liner 22 and the door cover 21 to narrow toward the bottom to thereby increase the lower space of the washing compartment.

Depending on the internal component design, the inclined portion 224 may encompass the entire first region 220. Alternatively, the inclined portion 224 may only include a portion of the first region 220. Alternatively, the inclined portion 224 may extend vertically beyond the first region 220.

The exhaust unit 25 may include an exhaust duct 256. The exhaust duct 256 may be connected to the fan housing 253. The exhaust duct 256 may be connected to an outlet of the fan housing 253. The exhaust duct 256 may extend downward from the fan housing 253.

A width in a left-and-right direction (or horizontal width) of the exhaust duct 256 may increase as a distance from the fan housing 252 increases. The exhaust duct 256 may be connected to an exhaust port through which air is discharged.

The motor 255 may rotate the fan 252 so as to reduce the pressure of the intake duct 252 and to increase the pressure of the exhaust duct 256. When the fan 254 is rotated, air in the washing compartment 11 may be introduced into the intake duct 252 through the intake grille 251, and the air introduced into the intake duct 252 may flow to the exhaust duct 256 through the fan housing 253. The air in the exhaust duct 256 may be discharged to the outside of the dishwasher 1 through the exhaust port.

The sensor 40 may be disposed between the exhaust unit 25 and the dispenser 23. The sensor 40 may be disposed between the exhaust duct 256 and the dispenser 23 in the width direction of the door 20. The sensor 40 may be disposed below the fan housing 253.

The dishwasher 1 may include a bracket 24 on which the sensor 40 is mounted. The bracket 24 may be disposed between the exhaust duct 256 and the dispenser 23.

The bracket 24 may be connected to the exhaust unit 25. The bracket 24 may be connected to the exhaust duct 256. The bracket 24 may extend from the exhaust duct 256. The bracket 24 may be integrally formed with the exhaust duct 256.

Meanwhile, the bracket 24 may be connected to the dispenser 23, as will be described later with reference to FIG. 25.

The sensor 40 may be disposed at the rear of the bracket 24. The sensor 40 may be disposed between the bracket 24 and the door liner 22.

Figure 19:
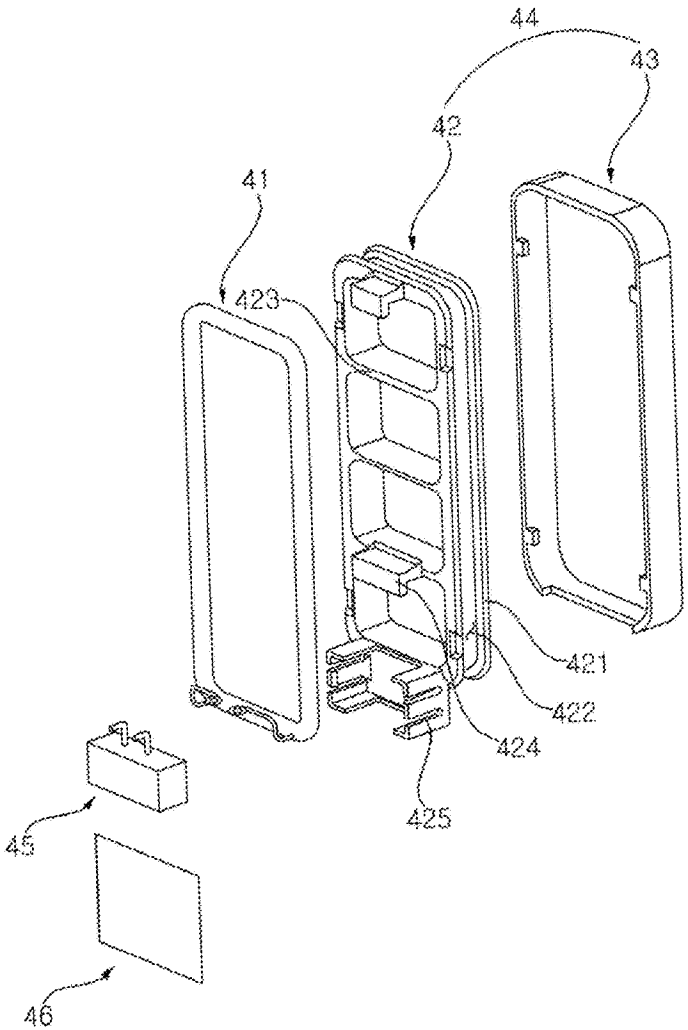
FIG. 19 illustrates a perspective view and an exploded perspective view of a sensor according to an embodiment of the present disclosure.
Figure 19:
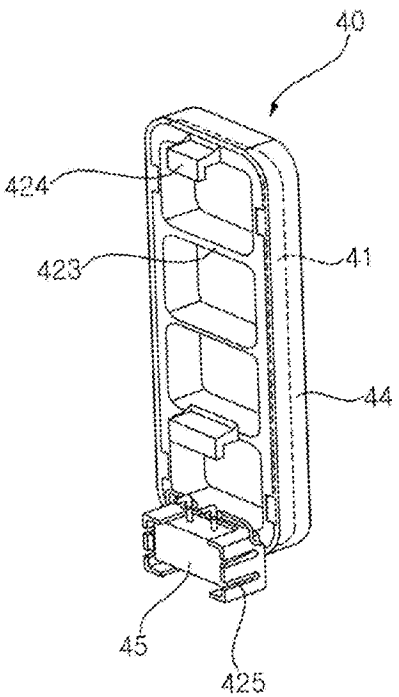

Referring to FIG. 19, the sensor 40 may detect a change in magnetic field. The sensor 40 may detect a change in distance from the magnet 70.

The sensor 40 may include a coil 41. When the magnitude of a magnetic field passing through the coil 41 is changed, a current may be induced in the coil 41.

The sensor 40 may include a frame 44. The coil 41 may be wound on the frame 44.

The frame 44 may be configured such that its vertical height is greater than its horizontal width. A vertical height of the coil 41 may be greater than a horizontal width of the coil 41.

The frame 44 may include an inner frame 42 on which the coil 41 is wound. The inner frame 42 may include an inner rim 421 disposed at an edge of the inner frame 42. The inner frame 42 may include a coil groove 422 recessed from the inner rim 421. The coil groove 422 may accommodate the coil 41.

The frame 44 may include an outer frame 43 disposed outside the inner frame 42. The outer frame 43 may cover the coil 41.

The outer frame 43 may be coupled to the inner frame 42. The outer frame 43 may be coupled to the inner rim 421. The coil 41 may be disposed in a space between the outer frame 43 and the coil groove 422.

The frame 44 may include a reinforcing rib 423. The reinforcing rib 423 may be connected to an inner periphery of the frame 44. The reinforcing rib 423 may be connected to the inner frame 42. The reinforcing rib 423 may extend in a left-and-right direction.

A plurality of reinforcing ribs 423 may be provided. The plurality of reinforcing ribs 423 may be arranged in an up-and-down direction.

The sensor 40 may include a fixing portion 424 coupled to the bracket 24. The fixing portion 424 may protrude from the frame 44. The fixing portion 424 may protrude forward from the frame 44.

Accordingly, the sensor 40 may be disposed between the bracket 24 and the door liner 22. The sensor 40 may be disposed adjacent to the washing compartment 11.

The fixing portion 424 may protrude from the inner frame 42. The fixing portion 424 may protrude from the inner rim 421 and/or the reinforcing rib 423.

The sensor 40 may include a PCB 46. The PCB 46 of the sensor 40 may be connected to the controller 30. The PCB 46 of the sensor 40 may be wired or wireless connected to the controller 30.

The sensor 40 may include a coupler 45. The coupler 45 may connect the coil 41 and the PCB 46.

The frame 44 may include a mount 425 in which the coupler 45 is disposed. The mount 425 may be disposed at the inner frame 42.

Figure 20:
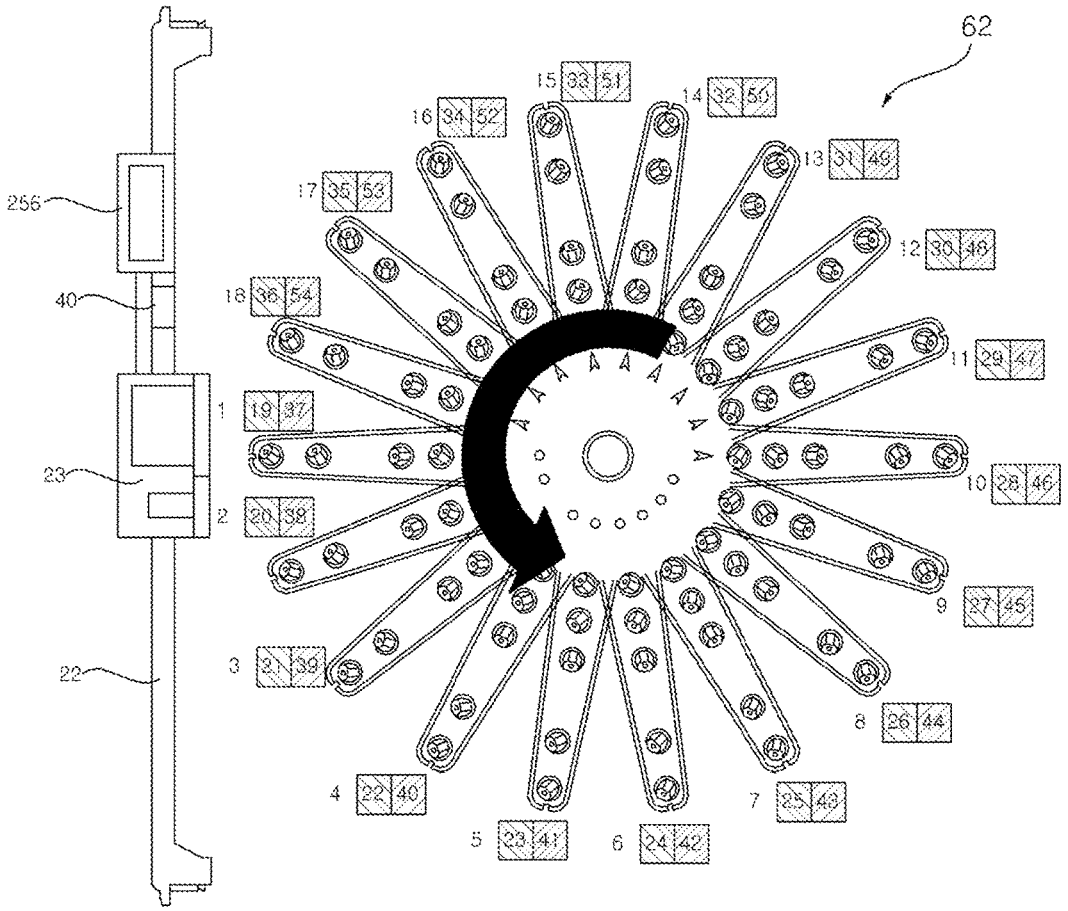
FIG. 20 is a top plan view illustrating the rotation of a second spray arm.

Referring to FIG. 20, the second spray arm 62 may be rotatably provided, the magnet 70 may rotate together with the second spray arm 62, and the sensor 40 may detect the magnetic force of the magnet 70.

When the second spray arm 62 rotates, it causes a change in distance between the magnet 70 and the sensor 40, so that a current may be induced in the coil 41. Accordingly, the sensor 40 may obtain information regarding whether the second spray arm 62 is rotating, the rotational speed, etc.

FIG. 20 illustrates a change in rotational position of the second spray arm 62 from rotational position 1 to rotational position 54. In the following, a description will be given using an example in which the second spray arm 62 rotates counterclockwise.

A rotational position 1 of the second spray arm 62 is a rotational position of the second spray arm 62 where the magnet 70 is closest to the dispenser 23, a rotational position 19 is a rotational position the same as the rotational position 1 after one full rotation (or 360°) of the second spray arm 62, and a rotational position 37 is a rotational position after two full rotations (or 720°) of the second spray arm 62.

Rotational positions 18, 36, and 54 represent positions where the distance between the magnet 70 and the sensor 40 is smallest. The distance between the magnet 70 and the sensor 40 decreases as the second spray arm 62 moves from a rotational position 17 to the rotational position 18, and the distance between the magnet 70 and the sensor 40 increases as the second spray arm 62 moves from the rotational position 18 to the rotational position 19. Similarly, the distance between the magnet 70 and the sensor 40 decreases as the second spray arm 62 moves from a rotational position 35 to the rotational position 36, and the distance between the magnet 70 and the sensor 40 increases as the second spray arm 62 moves from the rotational position 36 to the rotational position 37.

Figure 21:
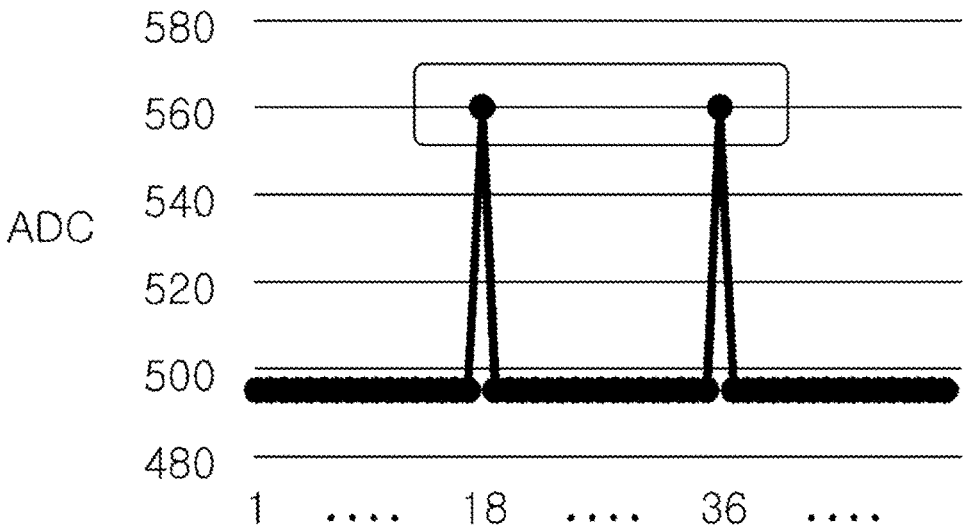
FIG. 21 is a graph showing a sensing value sensed by a sensor according to the rotation of the second spray arm in FIG. 20.

Referring to FIGS. 20 and 21, the sensor 40 may include an analog-to-digital converter (ADC).

As the second spray arm 62 rotates, a value detected by the sensor 40 may exhibit a peak at the position where the magnet 70 is closest to the sensor 40. The controller 30 or the sensor 40 may calculate the rotational speed of the second spray arm 62 by using a period of time over which the peak appears.

Figure 22:
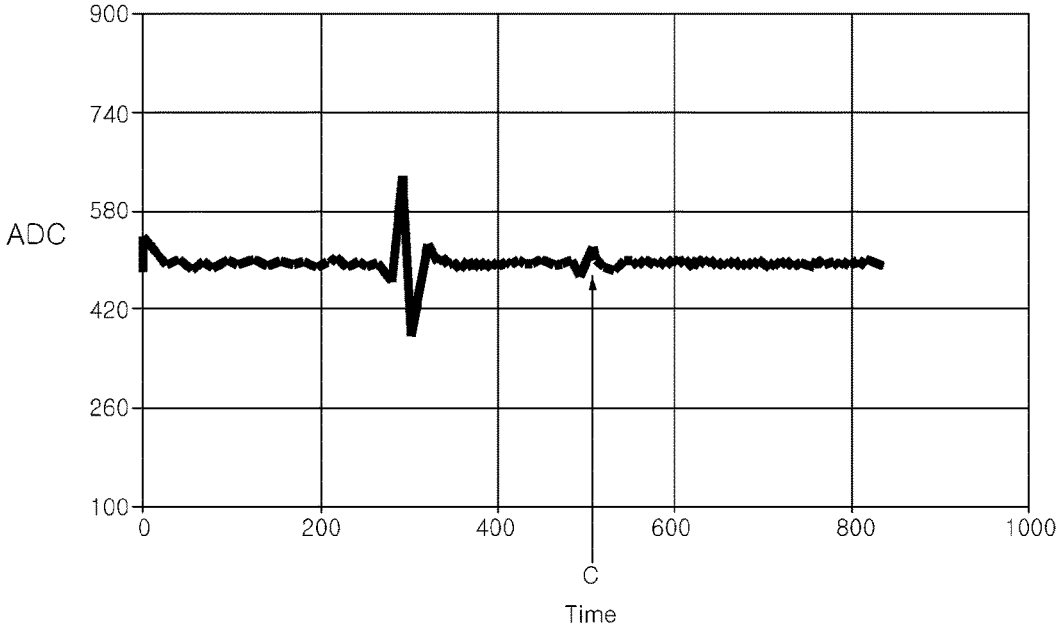
FIG. 22 is a graph showing a sensing value when the rotation of the second spray arm is restrained.

Referring to FIG. 22, a graph shows that a value detected by the sensor 40 (i.e., sensing value) or a value converted by the ADC remains at about 495, then increases to above 580 and then decreases to below 420 during a time interval between 200 and 400, which indicates that the distance of the magnet 70 from the sensor 40 increases again after decreasing during the time interval between 200 and 400.

Meanwhile, as described above, when the second spray arm 62 keeps rotating, a change in the value detected by the sensor 40 will again appear after the time interval between 200 and 400.

The graph of FIG. 22 is a graph showing a change in sensing value over time for the case where the second spray arm 62 is restrained at a point C.

Based on a sensing value or information on the graph, the controller 30 may determine whether the rotation of the second spray arm 62 is restrained.

In addition, when the sensing value does not reach a peak value within a predetermined time, the controller 30 may determine that the rotation of the second spray arm 62 is restrained.

Figure 23:
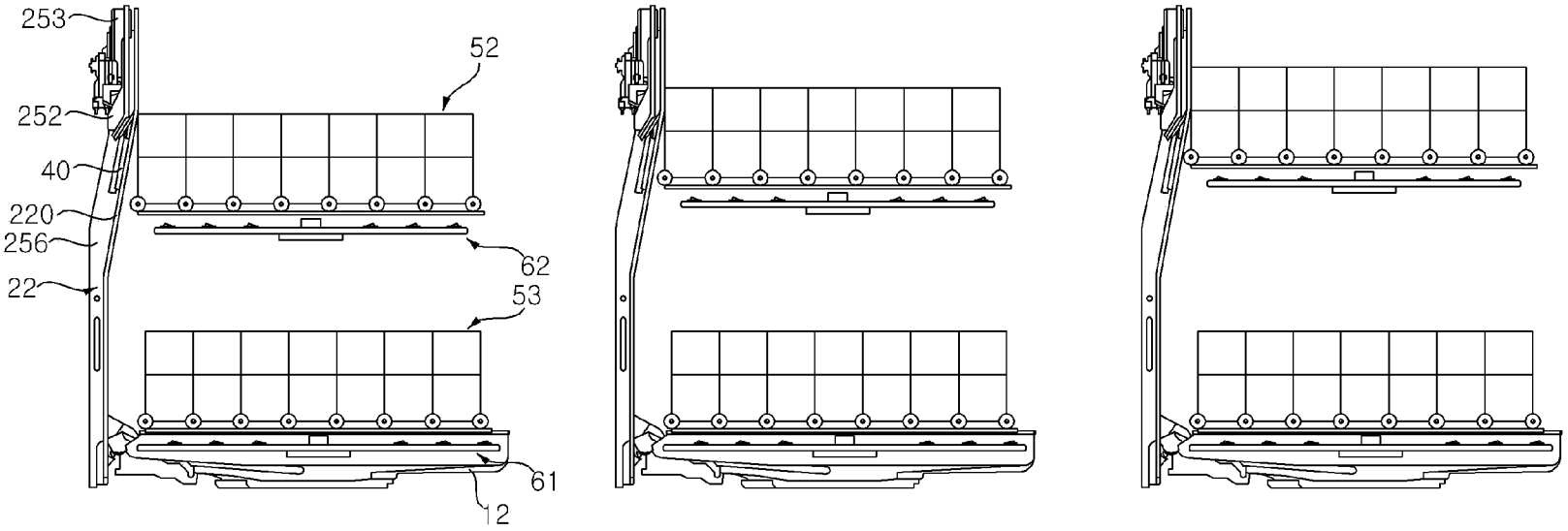
FIGS. 23 to 25 is a perspective view illustrating the height adjustment of a second spray arm and placement of a sensor.

Referring to FIG. 23, the second spray arm 62 may be adjustable in placement height. The second rack 52 may be adjustable in placement height.

The height at which the second rack 52 is placed may be varied according to various circumstances, such as the convenience of a user, the size of an object to be washed placed on the second rack 52, and the like, and the height of the second spray arm 62 may be adjusted accordingly.

(a) of FIG. 23 illustrates a state in which the second spray arm 62 and the second rack 52 are placed in a first position, and (b) of FIG. 23 illustrates a state in which the second spray arm 62 and the second rack 52 are placed in a second position located higher than the first position. (c) of FIG. 23 illustrates a state in which the second spray arm 62 and the second rack 52 are placed in a third position located higher than the second position.

The height at which the dispenser 23 and the sensor 40 are placed may be related to the height at which the second spray arm 62 is placed. In FIG. 23, the dispenser 23 is omitted to show the sensor 40. The dispenser 23 may be disposed at the same height as the sensor 40.

In detail, as described above, the dispenser 23 may be disposed at the same height as the spray arm 62 or at a position slightly higher than the second spray arm 62, so that wash water sprayed from at least one nozzle 6231 of the nozzles 623 of the second spray arm 62 reaches the dispenser 23.

When a distance D between the sensor 40 and the magnet 70 is large (see FIG. 24 or FIG. 25), it may be difficult for the sensor 40 to obtain information regarding the rotation of the second spray arm 62. The sensor 40 may be disposed at a height at which the dispenser 23 is disposed.

In a state (a) where the second spray arm 62 is placed in the first position, the second spray arm 62 may be positioned downward relative to the dispenser 23. Alternatively, the second spray arm 62 may be positioned at a height corresponding to a lower portion of the dispenser 23.

In the state (a) where the second spray arm 62 is placed in the first position, the second spray arm 62 may be positioned downward relative to the sensor 40.

In a state (b) where the second spray arm 62 is placed in the second position, the second spray arm 62 may be positioned downward relative to the dispenser 23. Alternatively, the second spray arm 62 may be positioned at a height corresponding to a lower portion of the dispenser 23.

In the state (b) where the second spray arm 62 is placed in the second position, the second spray arm 62 may be positioned downward relative to the sensor 40.

In a state (c) where the second spray arm 62 is placed in the third position, the second spray arm 62 may be positioned at a height corresponding to the dispenser 23.

In the state (c) where the second spray arm 62 is placed in the third position, the second spray arm 62 may be positioned at a height corresponding to the sensor 40. In the state (c) where the second spray arm 62 is placed in the third position, the second spray arm 62 may be disposed at a position corresponding to a lower portion of the sensor 40.

The door liner 22 may include a first region 220 in which the dispenser 23 and the sensor 40 are disposed. The first region 220 may be inclined so that its upper part is positioned rearward relative to its lower part while the door 20 is closed.

The sensor 40 may be disposed parallel to the first region 220 of the door liner 22.

The sensor 40 may be disposed below the fan housing 253. The sensor 40 may be disposed downward relative to the intake duct 252.

The dispenser 23 may be disposed below the fan housing 253 and the intake duct 252.

The sensor 40 may be disposed between the exhaust duct 256 and the dispenser 23 in the width direction (or left-and-right direction) of the door 20.

Figure 24:
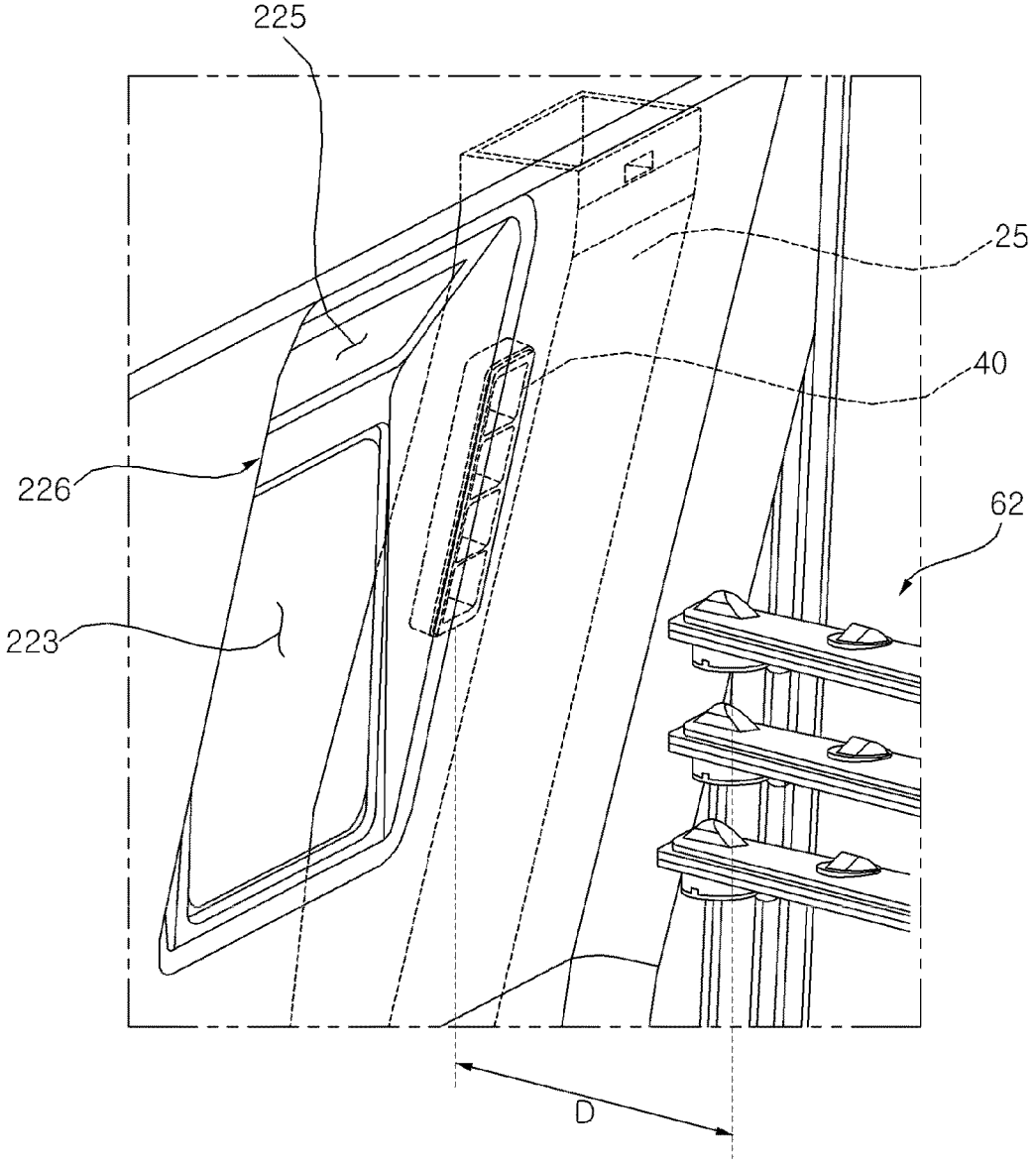
Figure 25:
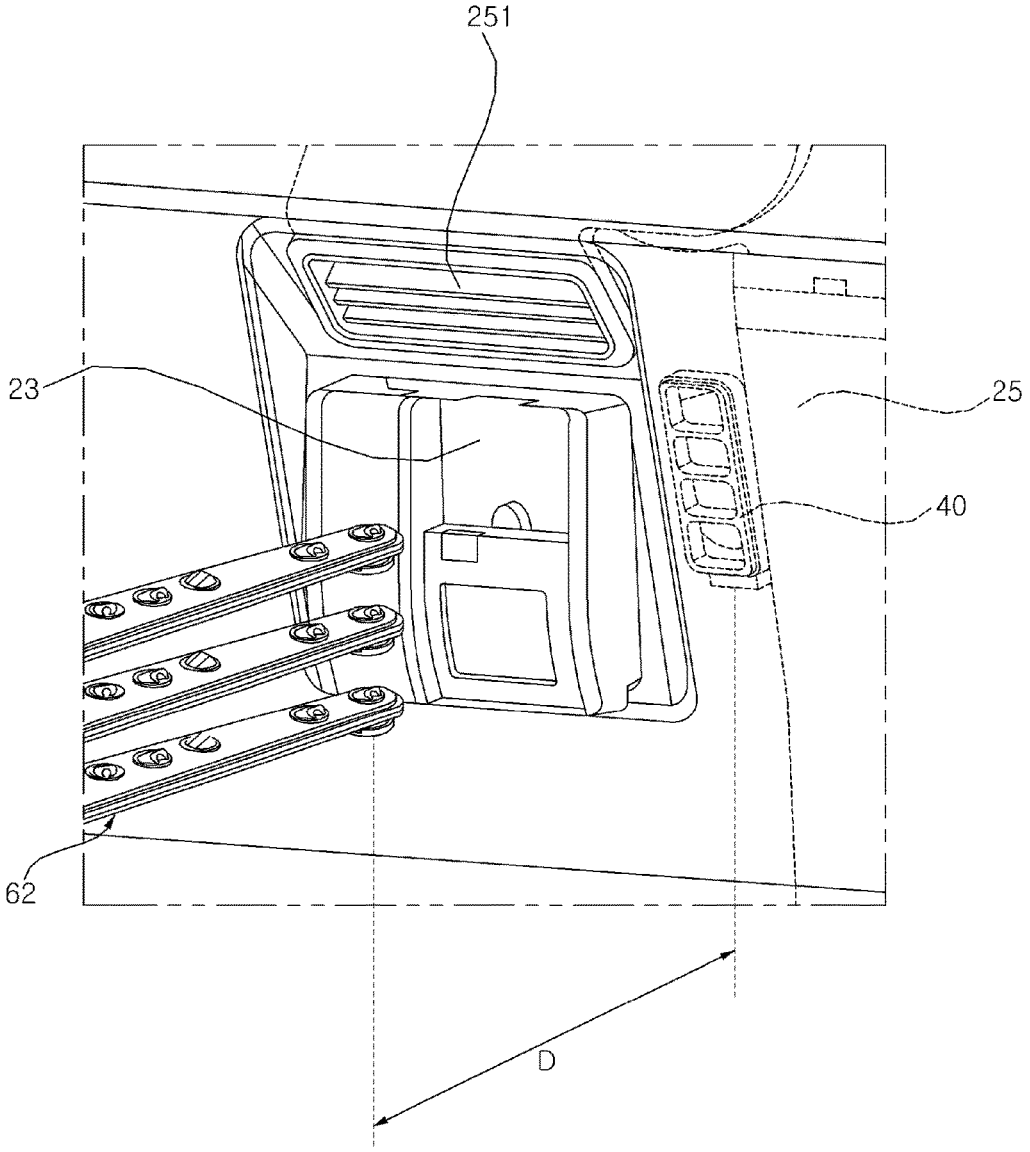

Referring to FIGS. 24 and 25, a height of the sensor 40 may be greater than a width of the sensor 40. The sensor 40 may be inclinedly disposed so that its upper portion is positioned rearward relative to its lower portion. The sensor 40 may be disposed parallel to the inclined portion 224 of the door liner 22.

The second spray arm 62 may be adjustable in placement height. FIG. 24 and FIG. 25 illustrate that the height of the second spray arm 62 is adjustable.

As described above, the height at which the second rack 52 is placed may be varied according to various circumstances, such as the convenience of a user, the size of an object to be washed placed on the second rack 52, and the like, and the height of the second spray arm 62 may be adjusted accordingly.

As the sensor 40 has a vertically long shape, the sensor 40 may obtain information regarding the rotation of the second spray arm 62 even when the placement height of the second spray arm 62 is varied.

The sensor 40 may be positioned upward relative to the magnet 70. An upper end of the sensor 40 may be disposed above the magnet 70.

The magnet 70 may be placed so that its poles are oriented in the up- and down direction.

As the sensor 40 is disposed upward relative to the magnet 70, and the magnet 70 has the pole facing upward, the sensor 40 may detect the magnetic force of the magnet 70 even when the distance D between the magnet 70 and the sensor 40 is somewhat large.

In addition, as the sensor 40 is inclined so that its upper portion is rearward relative to its lower portion, it is effective for detecting the magnetic force of the magnet 70.

The door 20 may include an installation portion 226 disposed at the door liner 22. The installation portion 226 may be recessed forward from the inclined portion 224.

The installation portion 226 may include a first installation recess 223 and a second installation recess 225. The first and second installation recesses 223 and 225 may be formed through the door liner 22. The second installation recess 225 may be located upward relative to the first installation recess 223.

The dispenser 23 may be disposed at the installation portion 226. The dispenser 23 may be inserted into the first installation recess 223. The dispenser 23 may be coupled to the first installation recess 223.

The intake grille 251 may be disposed at the installation portion 226. The intake grille 251 may be inserted into the second installation recess 225. The intake grille 251 may be coupled to the second installation recess 225.

Figure 26:
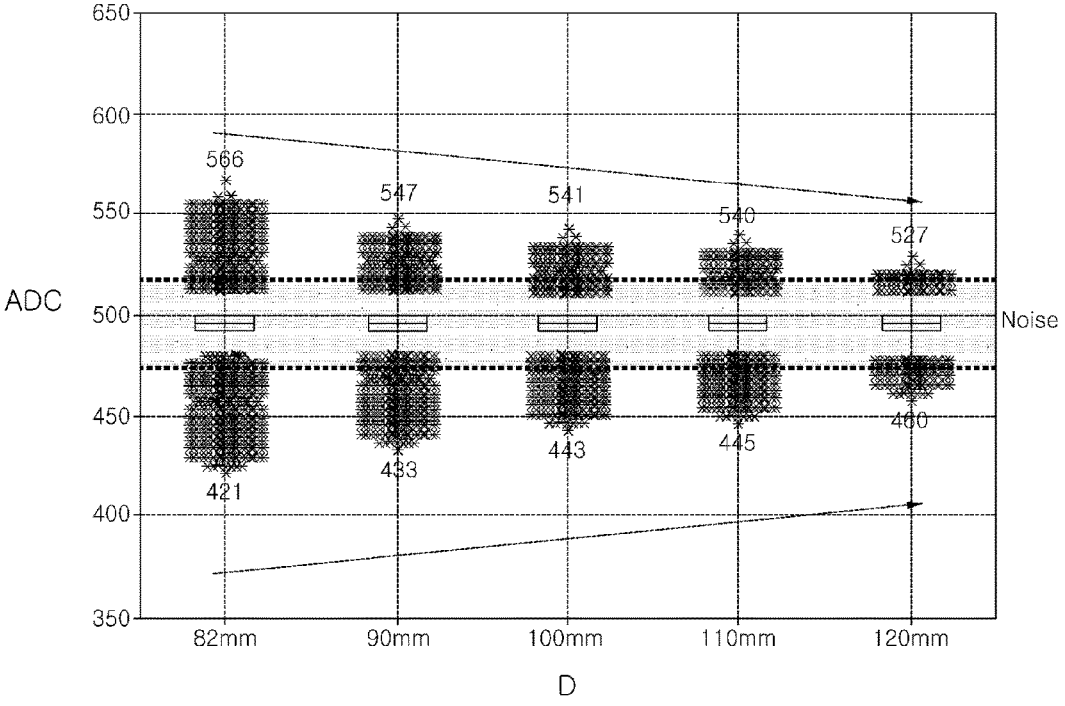
FIG. 26 is a graph showing the range of a sensing value according to a distance between a magnet and a sensor.

Referring to FIG. 26, it can be seen that the magnitude of a change in sensing value by the rotation of the second spray arm 62 varies with the distance D between the magnet 70 and the sensor 40. The distance between the door 20 and the magnet 70 is closest at a center of the door 20. When the sensor 40 is positioned at the center in the width direction of the door 20, the distance D between the sensor 40 and the magnet 70 may be smallest.

When the distance D between the sensor 40 and the magnet 70 is large, it may be difficult for the sensor 40 to obtain information regarding the rotation of the second spray arm 62.

As for the sensor 40 according to one embodiment of the present disclosure, when the second spray arm 62 is not rotating, the average sensing value is about 495 and the standard deviation is about 11.

When a maximum value and a minimum value of the sensing values, namely, a sensing value when the magnet 70 approaches the rotational position closest to the sensor 40 and a sensing value when the magnet 70 moves away from the sensor 40 are greater than or equal to $517(m-2\sigma)$ and less than or equal to $473(m+2\sigma)$, respectively, then information regarding the rotation of the second spray arm 62 obtained through the sensor 40 may be about 95% reliable or less.

Referring to FIGS. 24 to 26, as for the dishwasher 1 according to an embodiment of the present disclosure, when an end of the second spray arm 62 faces between the dispenser 23 and the exhaust unit 25, the distance D between the magnet 70 and the sensor 40 may be less than 120 mm.

Figure 27:
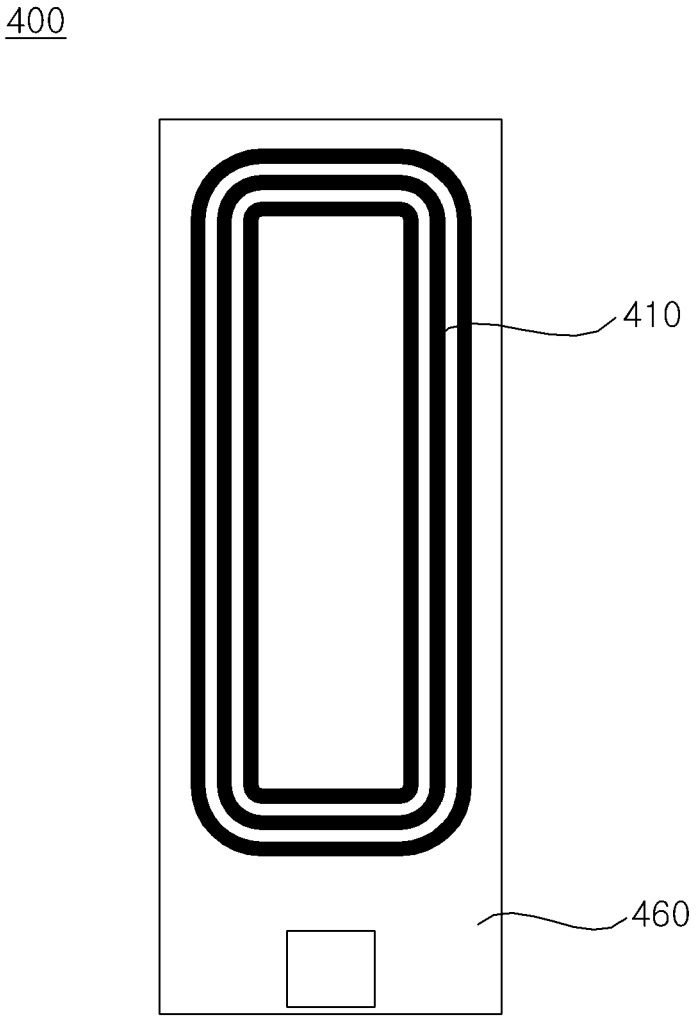
FIG. 27 is a front view of a sensor according to another embodiment of the present disclosure.

Referring to FIG. 27, a sensor 400 according to another embodiment of the present disclosure may include a coil 410 mounted on a PCB 460.

Description on the configuration identical or similar to that of the previous embodiment is omitted. Any or all elements of this embodiment and the previous embodiment may be combined or combined with each other in configuration or function.

Figure 28:
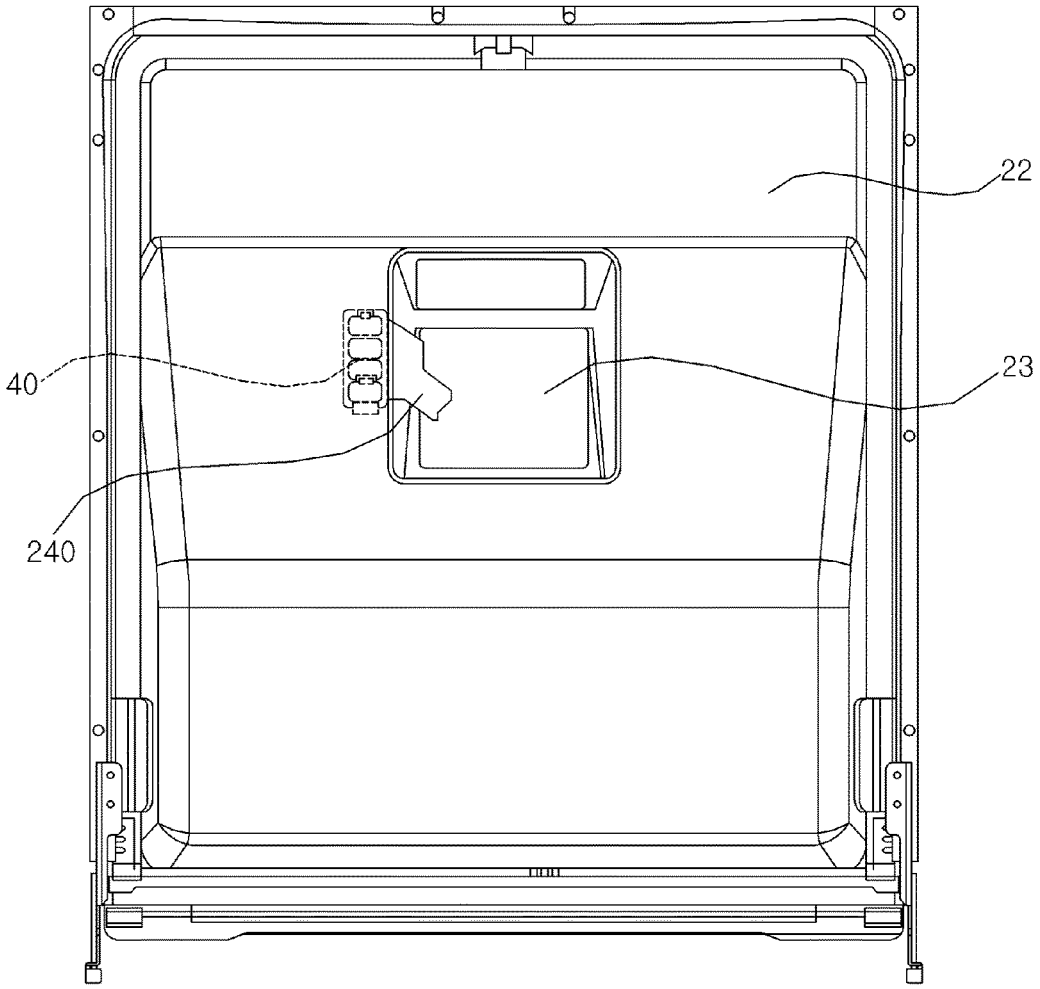
FIG. 28 is front view of a door with a door cover removed, according to another embodiment of the present disclosure.

Referring to FIG. 28, the door 20 according to another embodiment of the present disclosure does not include the exhaust unit 25 of the previous embodiment. A bracket 240 may be connected to the dispenser 23.

Description on the configuration identical or similar to that of the previous embodiment is omitted below. In addition, unless otherwise specified, this embodiment and the previous embodiment are not mutually exclusive or distinct from each other. That is, any or all elements of this embodiment and the previous embodiment may be combined or combined with each other in configuration or function.

Figure 29:
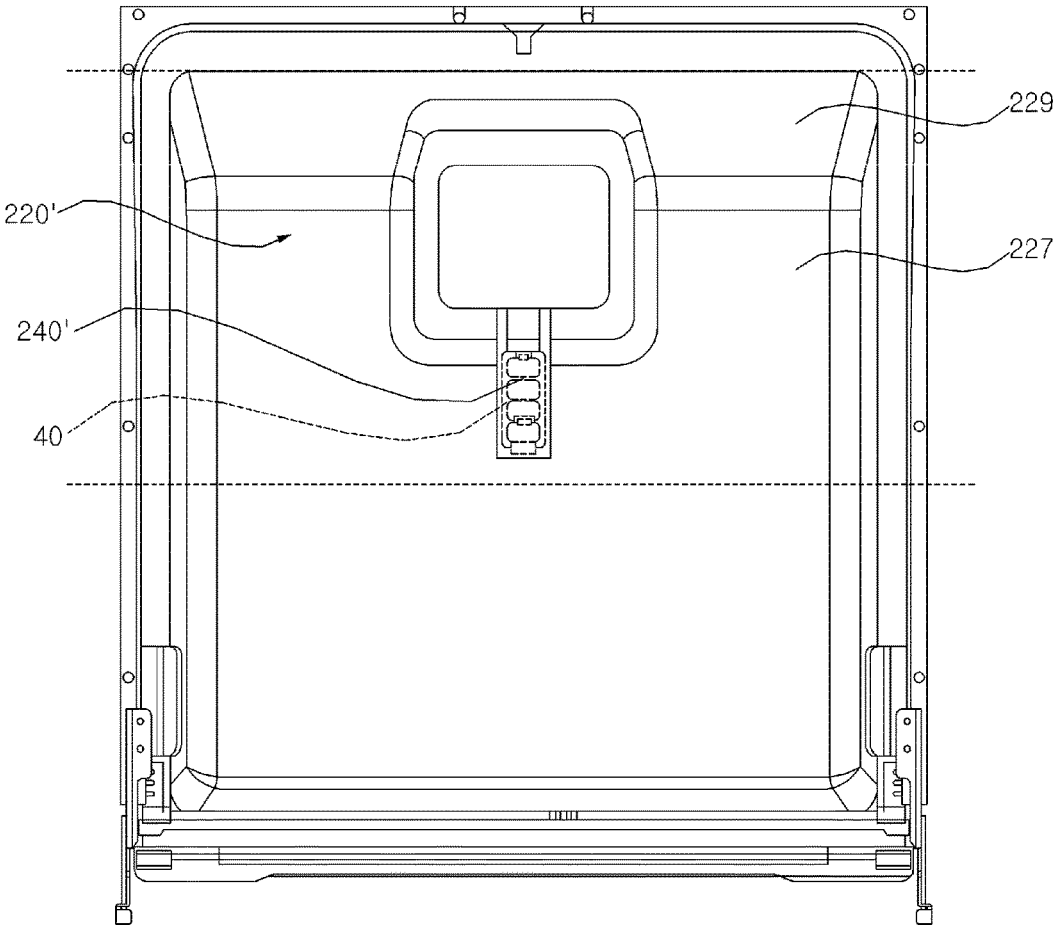
FIG. 29 is front view of a door with a door cover removed, according to yet another embodiment of the present disclosure.
Figure 30:
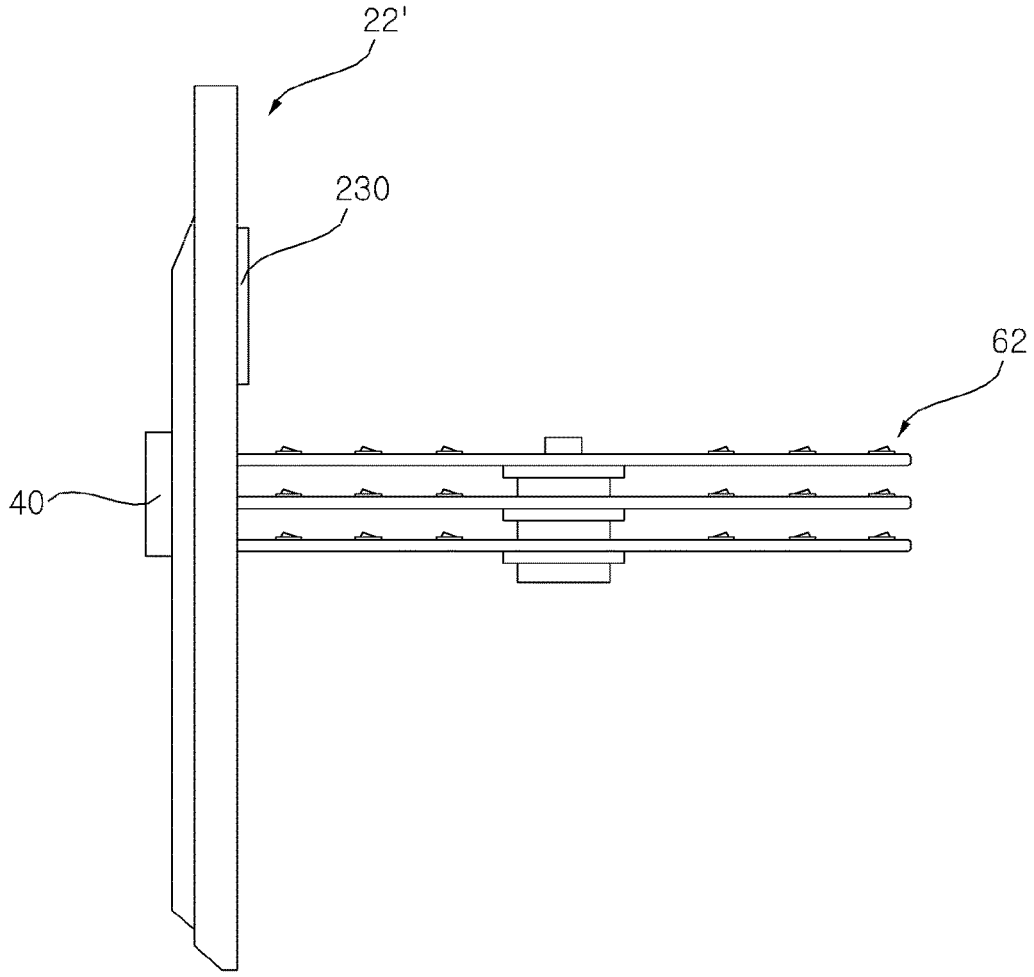
FIG. 30 is a side view illustrating the arrangement of a sensor and a second spray arm shown in FIG. 29.

Referring to FIGS. 29 and 30, a door liner 22' according to yet another embodiment of the present disclosure may include an inclined portion 229 that is disposed at an upper portion of the door liner 22', and a lower portion 227 that extends downward from the inclined portion 229.

A first region 220' of this embodiment may include the inclined portion 229 and an upper part of the lower portion 227. The first region 220' and the inclined portion 229 of this embodiment may be disposed at a higher position relative to the inclined portion 220 of the previous embodiment.

The door of this embodiment may not include the exhaust unit 25 of the previous embodiment. Accordingly, a space in which the fan housing 253 and the motor 255 are disposed may not be required. Thus, as the inclined portion 229 of this embodiment is disposed at a position higher than that of the inclined portion 224 of the previous embodiment, the door liner 22' of this embodiment may have a wider space of the washing compartment 11.

In addition, a dispenser 230 of this embodiment may be disposed at a position higher than that of the dispenser 23 of the previous embodiment. The dispenser 230 may be disposed across the inclined portion 229 and the lower portion 227.

The dispenser 230 may be disposed upward relative to the second spray arm 62.

The sensor 40 may be disposed below the dispenser 230. The sensor 40 may be disposed at a position corresponding to the second spray arm 62.

The second spray arm 62 may be adjustable in placement height.

An upper portion of the sensor 40 may correspond to a height at which the second spray arm 62 is placed in a highest position. A lower portion of the sensor 40 may correspond to a height at which the second spray arm 62 is placed in a lowest position.

A bracket 240 may be connected to the dispenser 230. The bracket 240 may be disposed below the dispenser 230.

Description on the configuration identical or similar to that of the previous embodiments is omitted below. In addition, unless otherwise specified, this embodiment and the previous embodiments described above are not mutually exclusive or distinct from each other. That is, any or all elements of this embodiment and the previous embodiments may be combined or combined with each other in configuration or function.

Figure 31:
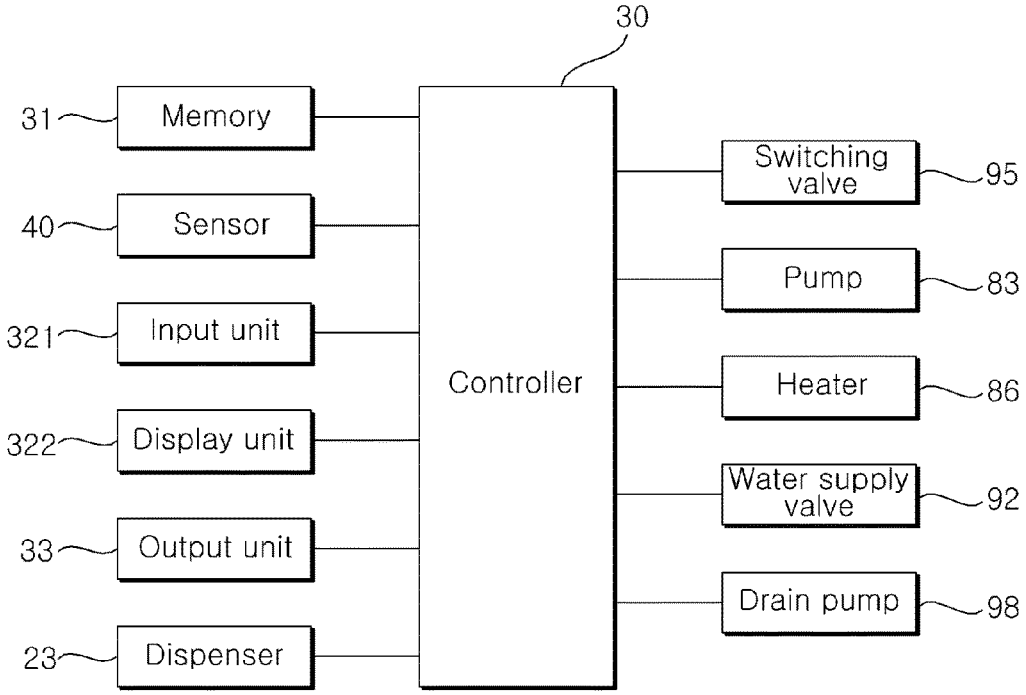
FIG. 31 is a block diagram illustrating a dishwasher according to an embodiment of the present disclosure.

Referring to FIG. 31, the controller 30 may control the dishwasher 1. The controller 30 may obtain, through the sensor 40, information regarding the rotation of the second spray arm 62. The controller 30 may receive information regarding the rotation of the second spray arm 62 from the sensor 40, and may control the dishwasher 1 based on the received information.

The controller 30 may control the pump 83. The controller 30 may control the motor 831 of the pump 83. The controller 30 may control a rotational speed of the motor 831.

The controller 30 may control the switching valve 95. The controller 30 may control the switching valve 95, so that the pump 83 is connected to at least one of the first spray arm 61, the second spray arm 62, and the top nozzle 63.

The controller 30 may control the heater 86. The controller 30 may control the heater 86 to adjust the temperature of wash water.

The controller 30 may control the water supply valve 92. The controller 30 may control the water supply valve 92 to regulate the water supply pipe 91. The controller 30 may control the water supply valve 92 so that water is supplied to the sump 80.

The controller 30 may control the drain pump 98. The controller 30 may drain the sump 80 through the drain pump 98.

The controller 30 may control the dispenser 23. The controller 30 may control the opening of the dispenser 23.

The interface 32 may include an input unit 321 and a display unit 322. The controller 30 may receive a command from a user through the input unit 321. The controller 30 may provide a user with information regarding the dishwasher through the display unit 322 and an output unit 33. The output unit 33 may be a speaker.

The dishwasher 1 may receive a command from a user through the input unit 321. The user may turn on or off the dishwasher 1 through the input unit 321. The user may select a wash course and option through the input unit 321.

The dishwasher 1 may include a memory 31 in which information regarding a wash course and the like are stored.

The controller 30 may proceed with washing based on the information regarding the wash course stored in the memory 31.

The wash course may be performed in several modes according to a user's selection: normal, heavy, delicate, top/bottom half load, etc. The wash course may be divided into several specific cycles between the start and end of the wash course. The wash course may include a pre-wash cycle, a main wash cycle, a rinse cycle, a steam cycle, and a dry cycle. Wash water may be supplied to the sump at the start of each cycle of the pre-wash cycle, the main wash cycle, the rinse cycle, the steam cycle, and the dry cycle. The wash water in the sump may be drained to the outside at the end of each cycle of the pre-wash cycle, the main wash cycle, the rinse cycle, and the steam cycle.

Figure 32:
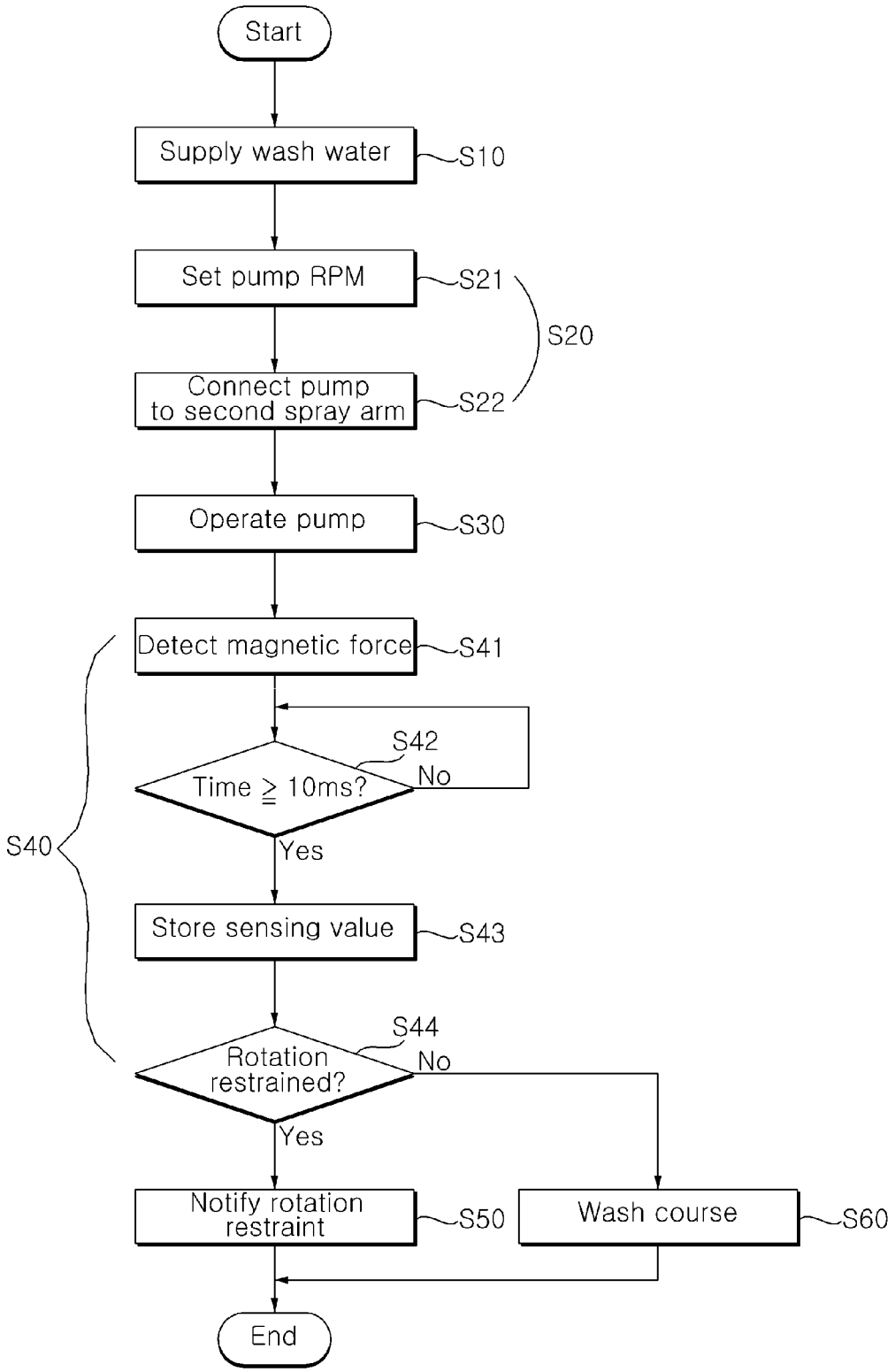
FIG. 32 is a flowchart illustrating a method of controlling a dishwasher according to an embodiment of the present disclosure.

Referring to FIG. 32, the controller 30 may open the water supply valve 92 at the start of the cycles to supply wash water to the sump 60 (S10).

The controller 30 may set a rotational speed of the motor 831 of the pump 83 (S21). The controller 30 may control the switching valve 95, so that the pump 83 is connected to the second spray arm 62 (S22). The connecting of the pump 83 to the second spray arm 62 and the setting of the pump 83 (S20) may be performed before, during, or after the supplying of the wash water (S10).

After supplying the wash water to the sump 60 and connecting the second spray arm 62 to the pump 83, the controller 30 may rotate the second spray arm 62 (S30). For example, the controller 30 may operate the pump 83 to rotate the second spray arm 62, so that the second spray arm 62 may be rotated by a reaction force of the force of wash water sprayed through the second nozzle 623.

Based on information regarding the rotation or rotation restraint of the second spray arm 62 obtained from the sensor 40 while the pump 83 is operated (S40), the controller 30 may output a rotation restrained state of the second spray arm 62 (S50), or may control the pump 83 so that a wash course is performed according to the wash course stored in the memory 31 (S60).

The sensor 40 may detect a magnetic force (S41) while the pump 83 is operated (S30).

The sensor 40 may detect the magnetic force regardless of the wash course and/or cycle, as long as the pump 83 is operated (S30). For example, before staring the wash course (i.e., before starting the pre-wash cycle), the controller 30 may operate the pump 83, and the sensor 40 may detect the magnetic force of the magnet 70. For example, regardless of the pre-wash cycle, the main wash cycle, the rinse cycle, the steam cycle, and the dry cycle, the controller 30 may operate the pump 83, and the sensor 40 may detect the magnetic force of the magnet 70.

At every predetermined time interval (S42), the controller 30 may store a value detected by the sensor 40 (i.e., sensing value) or an ADC value in the memory 31 (S43). The predetermined time interval may be 10 ms (10/1000 seconds).

Based on the number of times of detecting the magnetic force of the magnet 40 by the sensor 40 within the predetermined time interval, the controller 30 may determine whether the second spray arm 62 is restrained (S44). When the magnetic force of the magnet 40 is not detected by the sensor 40 at least two times within the predetermined time interval, the controller 30 may determine that the second spray arm 62 is restrained.

Before starting the wash course, when it is determined that the second spray arm 62 is restrained, the controller 30 may output the rotation restrained state through the display unit 322, the output unit 33, or an external device (S50). Alternatively, when it is determined that the second spray arm 62 is restrained, the controller 30 may output the rotation restrained state through the display unit 322, the output unit 33, or an external device while performing a cycle regardless of the pre-wash cycle, the main wash cycle, the rinse cycle, the steam cycle, and the dry cycle (S50). For example, the external device may be a user's smart phone. Alternatively, the external device may be an external server, and a message or notification may be output to a user's smart phone through the external server.

When it is determined that the second spray arm 62 is restrained, the controller 30 may terminate without performing the wash course. Before starting the wash cycle (i.e., before starting the pre-wash cycle), when it is determined that the second spray arm 62 is restrained, the controller 30 may output the rotation restrained state and terminate without performing the wash course. During the wash course (i.e., during a cycle regardless of the pre-wash cycle, the main wash cycle, the rinse cycle, the steam cycle, and the dry cycle), when it is determined that the second spray arm 62 is restrained, the controller 30 may output the rotation restrained state and terminate the wash course without proceeding further.

When the magnetic force of the magnet 70 is detected two times or more within the predetermined time interval, the controller 30 may determine that the rotation of the second spray arm 62 is not restrained. When it is determined that the rotation of the second spray arm 62 is not restrained, the controller 30 may perform the wash course stored in the memory 31 (S60). For example, the controller 30 may control the pump 83 according to the prestored wash course.

Before starting the wash course (i.e., before starting the pre-wash cycle), when it is determined that the rotation of the second spray arm 62 is not restrained, the controller 30 may perform the set wash course. Regardless of the pre-wash cycle, the main wash cycle, the rinse cycle, the steam cycle, and the dry cycle, the controller 30 may determine whether the rotation of the second spray arm 62 is restrained. When it is determined that the rotation of the second spray arm 62 is not restrained, the controller 30 may continue the ongoing cycle without any change.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings, and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dishwasher comprising:

a tub that defines a washing compartment;

a door configured to open and close the washing compartment;

a rack disposed in the washing compartment;

a spray arm configured to rotate in the washing compartment, the spray arm comprising a nozzle configured to spray wash water toward the rack;

a connector disposed at the spray arm, the connector having an opening;

a cap configured to couple to the connector and to cover the opening of the connector;

a magnet disposed between the connector and the cap;

a sensor disposed at the tub or the door and configured to detect magnetic force of the magnet; and a gasket disposed between the connector and the cap, wherein the cap comprises:

a bottom wall configured to cover the opening of the connector, and a lateral wall that protrudes from the bottom wall and defines a magnet accommodating space that accommodates the magnet, the lateral wall being configured to be inserted to an inside of the connector, and wherein the gasket is disposed between the lateral wall and the connector.

2. The dishwasher of claim 1, wherein the connector comprises a stopper that protrudes from an inner surface of the connector, the stopper being spaced apart from the bottom wall of the cap, and wherein the gasket is disposed between the stopper and the bottom wall of the cap.

3. The dishwasher of claim 1, wherein the bottom wall of the cap comprises:

an inner bottom portion that is disposed laterally inside the lateral wall and defines a bottom of the magnet accommodating space surrounded by the lateral wall; and an outer bottom portion disposed laterally outside the lateral wall, wherein the cap further comprises a rim that protrudes from the outer bottom portion, and wherein the connector is inserted between the lateral wall and the rim.

4. The dishwasher of claim 3, wherein the connector comprises a protruding portion that protrudes from an outer surface of the connector, and wherein the cap further comprises:

an extended portion recessed outward from an inner surface of the rim, the extended portion defining a groove configured to receive the protruding portion of the connector; and a coupling portion that protrudes from the extended portion and is configured to engage with the protruding portion of the connector.

5. The dishwasher of claim 4, wherein the cap defines a through-hole that passes through the bottom wall, the through-hole being defined at a position corresponding to the coupling portion.

6. The dishwasher of claim 1, wherein the cap further comprises a rib that protrudes from an inner surface of the lateral wall of the cap and is configured to be in contact with the magnet.

7. The dishwasher of claim 1, wherein the connector protrudes downward relative to the spray arm, the connector having an open lower surface that defines the opening, wherein the cap is configured to cover the open lower surface of the connector, and wherein the magnet is disposed below the spray arm.

8. The dishwasher of claim 7, wherein the nozzle protrudes from an upper surface of the spray arm, and wherein the magnet is disposed vertically below the nozzle.

9. The dishwasher of claim 7, wherein the spray arm further comprises a downward-facing nozzle that protrudes from a lower surface of the spray arm, and wherein the connector is positioned farther from a center of rotation of the spray arm than the downward-facing nozzle.

10. The dishwasher of claim 7, wherein a vertical height of the magnet is greater than a horizontal width of the magnet.

11. The dishwasher of claim 10, wherein an upper end of the sensor is positioned upward relative to the magnet, and wherein poles of the magnet are oriented in an up-down direction.

12. The dishwasher of claim 11, further comprising an iron plate disposed in the magnet accommodating space, the iron plate being disposed below the magnet.

13. The dishwasher of claim 12, further comprising a silver foil disposed in the magnet accommodating space, the silver foil being disposed below the iron plate.

14. A dishwasher comprising:

a tub that defines a washing compartment;

a pump configured to supply wash water;

a first rack disposed in the washing compartment;

a first spray arm deposed below the first rack, the first spray arm comprising a first nozzle configured to spray the wash water toward the first rack;

a second rack disposed in the washing compartment and positioned below the first rack;

a second spray arm disposed below the second rack and above the first rack, the second spray arm comprising a second nozzle configured to spray the wash water toward the second rack;

a connector that protrudes downward from the second spray arm, the connector having an open lower surface;

a cap configured to cover the open lower surface;

a magnet disposed in an accommodating space that is defined by the connector and the cap; and a sensor configured to detect magnetic force of the magnet, wherein a vertical height of the magnet is greater than a horizontal width of the magnet, and poles of the magnet are oriented in an up-down direction, and wherein the sensor has an upper end positioned upward relative to the magnet.

15. The dishwasher of claim 14, further comprising an iron plate disposed in the accommodating space and disposed below the magnet.

16. The dishwasher of claim 15, further comprising a silver foil disposed in the accommodating space, the silver foil being disposed below the iron plate.

17. The dishwasher of claim 14, further comprising a gasket disposed between the connector and the cap.

18. The dishwasher of claim 17, wherein the cap comprises:

a bottom wall configured to cover the open lower surface of the connector; and a lateral wall that protrudes from the bottom wall and defines the accommodating space, the lateral wall being configured to be inserted to an inside of the connector, and wherein the gasket is disposed laterally between the lateral wall and the connector in a direction parallel to the bottom wall.

19. A dishwasher comprising:

a tub that defines a washing compartment;

a pump configured to supply wash water;

a first rack disposed in the washing compartment;

a first spray arm deposed below the first rack, the first spray arm comprising a first nozzle configured to spray the wash water toward the first rack;

a second rack disposed in the washing compartment and positioned below the first rack;

a second spray arm disposed below the second rack and above the first rack, the second spray arm comprising a second nozzle configured to spray the wash water toward the second rack;

a connector that protrudes downward from the second spray arm, the connector having an open lower surface;

a cap configured to cover the open lower surface;

a gasket disposed between the connector and the cap;

a magnet disposed in an accommodating space that is defined by the connector and the cap; and a sensor configured to detect magnetic force of the magnet, wherein a vertical height of the magnet is greater than a horizontal width of the magnet.

20. The dishwasher of claim 19, wherein the cap comprises:

a bottom wall configured to cover the open lower surface of the connector; and a lateral wall that protrudes from the bottom wall and defines the accommodating space, the lateral wall being configured to be inserted to an inside of the connector, and wherein the gasket is disposed laterally between the lateral wall and the connector in a direction parallel to the bottom wall.

* * * * *